US008919233B2

(12) United States Patent
Lewis et al.

(10) Patent No.: US 8,919,233 B2
(45) Date of Patent: Dec. 30, 2014

(54) ELECTRONIC PRE-CUT SHEET DISPENSER WITH DISPENSING ADJUSTMENTS

(75) Inventors: Richard Paul Lewis, Marietta, GA (US); Paul Francis Tramontina, Harleysville, PA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 1036 days.

(21) Appl. No.: 12/981,588

(22) Filed: Dec. 30, 2010

(65) Prior Publication Data

US 2012/0167739 A1 Jul. 5, 2012

(51) Int. Cl.
*B26D 5/00* (2006.01)
*B65H 7/00* (2006.01)

(52) U.S. Cl.
USPC ..... 83/361; 83/370; 83/649; 225/39; 225/47

(58) Field of Classification Search
USPC ..... 83/361, 370, 649; 225/39, 47, 6, 10
See application file for complete search history.

(56) References Cited

U.S. PATENT DOCUMENTS

| | | | | |
|---|---|---|---|---|
| 3,361,021 | A * | 1/1968 | Toth | 83/358 |
| 4,826,262 | A * | 5/1989 | Hartman et al. | 312/34.12 |
| 5,141,142 | A * | 8/1992 | Ramsey | 225/4 |
| 5,217,035 | A * | 6/1993 | Van Marcke | 137/1 |
| 5,704,566 | A * | 1/1998 | Schutz et al. | 242/595 |
| 5,772,291 | A * | 6/1998 | Byrd et al. | 312/34.22 |
| 5,984,049 | A | 11/1999 | Lammers | |
| 6,069,354 | A * | 5/2000 | Alfano et al. | 250/221 |
| 6,079,305 | A * | 6/2000 | Bloch et al. | 83/335 |
| 6,168,679 | B1 * | 1/2001 | Biagiotti | 156/64 |
| 6,279,777 | B1 * | 8/2001 | Goodin et al. | 222/52 |
| 6,293,486 | B1 * | 9/2001 | Byrd et al. | 242/564.1 |
| 6,321,963 | B1 * | 11/2001 | Gracyalny et al. | 225/2 |
| 6,409,401 | B1 * | 6/2002 | Petteruti et al. | 400/88 |
| 6,412,678 | B2 * | 7/2002 | Gracyalny et al. | 225/2 |
| 6,412,679 | B2 * | 7/2002 | Formon et al. | 225/14 |
| 6,419,136 | B2 * | 7/2002 | Formon et al. | 225/14 |
| 6,607,160 | B2 | 8/2003 | Lewis et al. | |
| 6,669,071 | B1 * | 12/2003 | Menna | 225/106 |
| 6,685,074 | B2 * | 2/2004 | Gracyalny et al. | 225/2 |
| 6,861,025 | B2 * | 3/2005 | Erickson et al. | 264/555 |
| 6,892,620 | B2 * | 5/2005 | Kapiloff | 83/649 |
| 6,953,292 | B2 * | 10/2005 | Menendez et al. | 400/70 |
| 7,040,566 | B1 | 5/2006 | Rodrian et al. | |
| 7,044,421 | B1 | 5/2006 | Omdoll et al. | |
| 7,149,658 | B2 * | 12/2006 | Kadaba | 702/184 |
| 7,546,973 | B2 * | 6/2009 | Budz et al. | 242/563 |
| 7,624,664 | B2 * | 12/2009 | Morris et al. | 83/648 |
| 7,726,599 | B2 * | 6/2010 | Lewis et al. | 242/563 |

(Continued)

FOREIGN PATENT DOCUMENTS

WO WO 2009/055473 A1 4/2009

*Primary Examiner* — Sean Michalski
(74) *Attorney, Agent, or Firm* — Nancy M. Klembus; Ralph H. Dean

(57) ABSTRACT

The present invention provides a dispenser for dispensing pre-cut sheets from a roll or a web material to a user in need of the web material. The dispenser contains a product identification sensor in communication with a control circuit. This product identification sensor detects and identifies information about the roll of the web material placed in the holder and relays this information to the control circuit. The control circuit adjusts dispensing parameters for the actuator roller in dispensing a sheet of the web material from the dispenser.

16 Claims, 20 Drawing Sheets

(56) References Cited

U.S. PATENT DOCUMENTS

| | | | | |
|---|---|---|---|---|
| 7,987,756 | B2 * | 8/2011 | Lewis et al. | 83/338 |
| 8,581,722 | B2 * | 11/2013 | Romaine et al. | 340/539.13 |
| 8,698,606 | B2 * | 4/2014 | Choi et al. | 340/10.6 |
| 2002/0030061 | A1 * | 3/2002 | Formon | 221/13 |
| 2002/0109036 | A1 * | 8/2002 | Denen et al. | 242/560 |
| 2003/0025027 | A1 * | 2/2003 | Ebisawa et al. | 242/525.4 |
| 2003/0167893 | A1 * | 9/2003 | Morris et al. | 83/649 |
| 2005/0011987 | A1 | 1/2005 | Lemaire et al. | |
| 2005/0145745 | A1 | 7/2005 | Lewis et al. | |
| 2006/0173576 | A1 | 8/2006 | Georg et al. | |
| 2007/0152010 | A1 * | 7/2007 | Denen et al. | 225/10 |
| 2007/0158359 | A1 | 7/2007 | Rodrian | |
| 2009/0024584 | A1 * | 1/2009 | Dharap et al. | 707/3 |
| 2009/0025524 | A1 * | 1/2009 | Kasugai et al. | 83/649 |
| 2009/0140001 | A1 | 6/2009 | Lewis et al. | |
| 2009/0177315 | A1 | 7/2009 | Goeking et al. | |
| 2009/0256022 | A1 | 10/2009 | Maurer | |
| 2010/0120593 | A1 * | 5/2010 | Bohm et al. | 493/11 |
| 2010/0132529 | A1 * | 6/2010 | Miyazaki | 83/649 |
| 2010/0301157 | A1 | 12/2010 | Keily et al. | |
| 2011/0162499 | A1 * | 7/2011 | Cooper | 83/76.8 |
| 2012/0125968 | A1 * | 5/2012 | Friesen et al. | 225/10 |

* cited by examiner

ELECTRONIC PRE-CUT SHEET DISPENSER WITH DISPENSING ADJUSTMENTS

FIELD OF THE INVENTION

The present invention is directed to a dispenser for dispensing sheets from a roll of a web material, such as, for example a paper towel.

BACKGROUND OF THE INVENTION

There are a number of dispensers known in the art for dispensing and cutting sheets of paper toweling or other similar materials. These dispensers are generally divided into two types of dispensers. The first type is a dispenser which the user needs to physically contact the dispenser to dispense a sheet of the material from the dispenser. Generally, the first type of dispenser is typically one which has a lever or push bar that the user contacts and manipulates to dispense the sheet of the web material. The second type of dispenser is a "sanitary" or "no-touch" dispenser. "Sanitary" or "no-touch" dispensers allow a user to obtain a sheet of the web material by only touching the web material extending from the dispenser or by activating an electronic sensor to advance the web material. There is no need for a user to touch any part of the dispenser in order to obtain a sheet from the dispenser of the second type.

Currently available sanitary or no-touch dispensers are operated either manually or electronically. In manual sanitary or no-touch dispensers, the process of dispensing and cutting the web material is carried out automatically by a user pulling on the free "tail" end of the web material that extends from a dispensing slot in the dispenser. In a typical configuration, the web material is engaged against a rough friction-enhancing surface of a feed drum and the action of pulling the web tail causes the drum to rotate. The drum often includes a drive mechanism and, after the initial pull on the web tail by a user, the drum is driven a predetermined rotational degree to dispense a metered amount of the web material, which is referred to as a "sheet" or a "sheet of the web material". A cam driven cutting mechanism may be provided in the rotating drum that pivots out of a slot in the drum to automatically cut the web at the proper length. This type of dispenser typically includes a stored energy mechanism, such as an eccentric cam, that is spring loaded during the initial rotation of the feed drum. This mechanism generally provides energy to aid in cutting the sheet from the web material, which is generally in roll form, and causes the drum to continue to rotate after the web has been cut to form the sheet. The dispensing action of the dispenser cuts the sheet from the roll of the web material. This action causes an additional length of the web material to be fed out of the dispensing slot as the tail for the next dispensing sequence. As a result, the user only touches the tail end of the web material during dispensing of a sheet of the web material.

Although effective, the conventional manual or mechanical sanitary dispensers utilizing automatic mechanical cutting and feeding mechanisms can be relatively difficult for some users, such as young children and elderly adults, to use. For some users, these manual or mechanical dispensers present an inordinate amount of resistance to pulling to obtain a sheet of the web material from the dispenser. This may be particularly true when the initial pulling action by the user also provides the force needed to load the potential energy spring of the automatic tail feeding mechanism. Further, the high resistance to pulling created by loading of the potential energy in the spring mechanism also means it is necessary for the web materials being dispensed from the dispensers to have a relatively high tensile strength. If the tensile strength of the web material is too low, the web will tend to tear during dispensing, which may cause the dispenser to jam. As a result, the next user will not be able to use the dispenser in a hands free mode to retrieve a sheet of the web material from the dispenser. Additionally, the torn pieces, or tabs, of the sheet material are often dropped on the floor presenting an undesired and unsightly mess on the washroom floor. Lower tensile products are desirable as they are generally softer and are more absorbent than higher tensile products.

Advances have been made in the art relating to purely electronic sanitary web material dispensers. With such dispensers, the unit is typically activated upon detection of motion of a user's arm or hand. A motor is subsequently energized through a control circuit and power source to drive a feed roll and thus dispense a measured length of the web material. This type of electronic dispenser requires the user to tear off the sheet of the web material from the dispenser. To do so, the user then grabs the exposed web material and pulls the web material at some angle to the dispenser cover causing a sheet to be separated from the web material on a cutting edge or serrated tear bar. The cycle is repeated for the next user.

Dispensers have become more specialized and are being designed by manufacturers to dispense a particular product. As a result, the dispenser's operation, including speed of operation, is optimized for that particular product or suite of products. If a different product, for example a product of a different product manufacturer, is inserted into the dispenser, the dispenser may not function properly. For example, the product may become jammed in the dispenser or the cutter blade in the dispenser will not properly cut the product being dispensed. This can be a problem for the manufacturer of the dispenser, since the dispenser will be perceived as a low quality dispenser when the product does not dispense properly; or it could be a problem for the manufacturer that manufactured the product being dispensed, the product could be perceived as being inferior.

There is a need in the art for an electronic pre-cut sheet dispenser that will effectively modify the dispensing parameters based on the rolled material placed in the dispenser and/or based on the actions of the user requiring a sheet of material from the dispenser.

SUMMARY OF THE INVENTION

Generally stated, the present invention provides a dispenser for dispensing a roll or a web material to a user in need of the web material. The dispenser of the present invention has a housing which forms an interior compartment of the dispenser. Within the interior compartment, there is a holder which serves to support at least one roll of a web material to be dispensed from the dispenser. The dispenser also has an actuator roller located within the compartment. The actuator roller has a cutting blade located within the actuator roller, wherein the cutting blade extends from the actuator roller to cut the web material to form a sheet of the web material to be dispensed from the dispenser during rotation of the actuator roller during the dispensing of a sheet of the web material. The dispenser also has a motor engagably connected to the actuator roller and a control circuit in communication with the motor. There is also a product identification sensor in communication with the control circuit. This product identification sensor detects and identifies information about the roll of the web material placed in the holder and relays this information to the control circuit. The control circuit adjusts dispensing parameters for the actuator roller in dispensing a sheet of the web material from the dispenser.

Also provided by the present invention is a dispenser for dispensing pre-cut sheets from a roll of a web material. The dispenser has a housing which forms an interior compartment of the dispenser; a holder located within the compartment, the holder serves to support at least one roll of a web material to be dispensed from the dispenser. Also present is an actuator roller located within the compartment, the actuator roller having a rotational path. The actuator roller has a cutting blade located within the actuator roller, wherein the cutting blade extends from the actuator roller to cut the web material to form a sheet of the web material to be dispensed from the dispenser during the rotational path of the actuator roller. The dispenser also has a motor engagably connected to the actuator roller; a control circuit in communication with the motor; and a removable battery compartment which facilitates replacement of batteries used to power the dispenser. The dispenser of the present invention further has a power supply electrically connected to the motor. The motor is activated with a motor activation means, which activates the motor, the motor activation means is in communication with the control circuit.

In another embodiment of the present invention the product identification sensor is a RFID reader, an ultraviolet light filter, an infrared filter, a capacitance detector, or a completed electrical circuit sensor.

The dispenser, in a further embodiment of the present invention, has a delay circuit, where the delay circuit delays the dispensing of the next sheet from the dispenser for a period of time. In further aspect of the present invention, the delay circuit delays the dispensing of the next sheet after two sheets are removed within a set period of time. In another embodiment of the present invention, the delay circuit time delay is adjusted with a multi-position switch.

In an additional embodiment of the present invention the dispenser has an activation sensor. The activation sensor is in communication with the control circuit, and the activation sensor detects the presence of a user's hand near the dispenser and sends a signal to the control circuit to dispense a sheet of the web material. In a particular embodiment, the activation sensor comprises an infrared sensor, a capacitive proximity sensor, or an ultrasonic proximity sensor. Generally, the activation sensor is located toward the bottom of the housing, and the activation sensor projects downward from the bottom of the housing.

In another embodiment of the present invention, the dispenser the control circuit adjusts the speed of the motor based on the product recognized.

The dispenser, in another embodiment, the control circuit engages the motor to dispense multiple sheets of the web material when the product identification sensor does not recognize the product loaded in the dispenser.

In an additional embodiment of the present invention the control circuit disengages the motor when the product identification sensor does not recognize the product loaded in the dispenser.

In a further embodiment of the present invention, the dispenser has a series of LED's to convey the maintenance state of the dispenser.

DEFINITIONS

Figure 1:
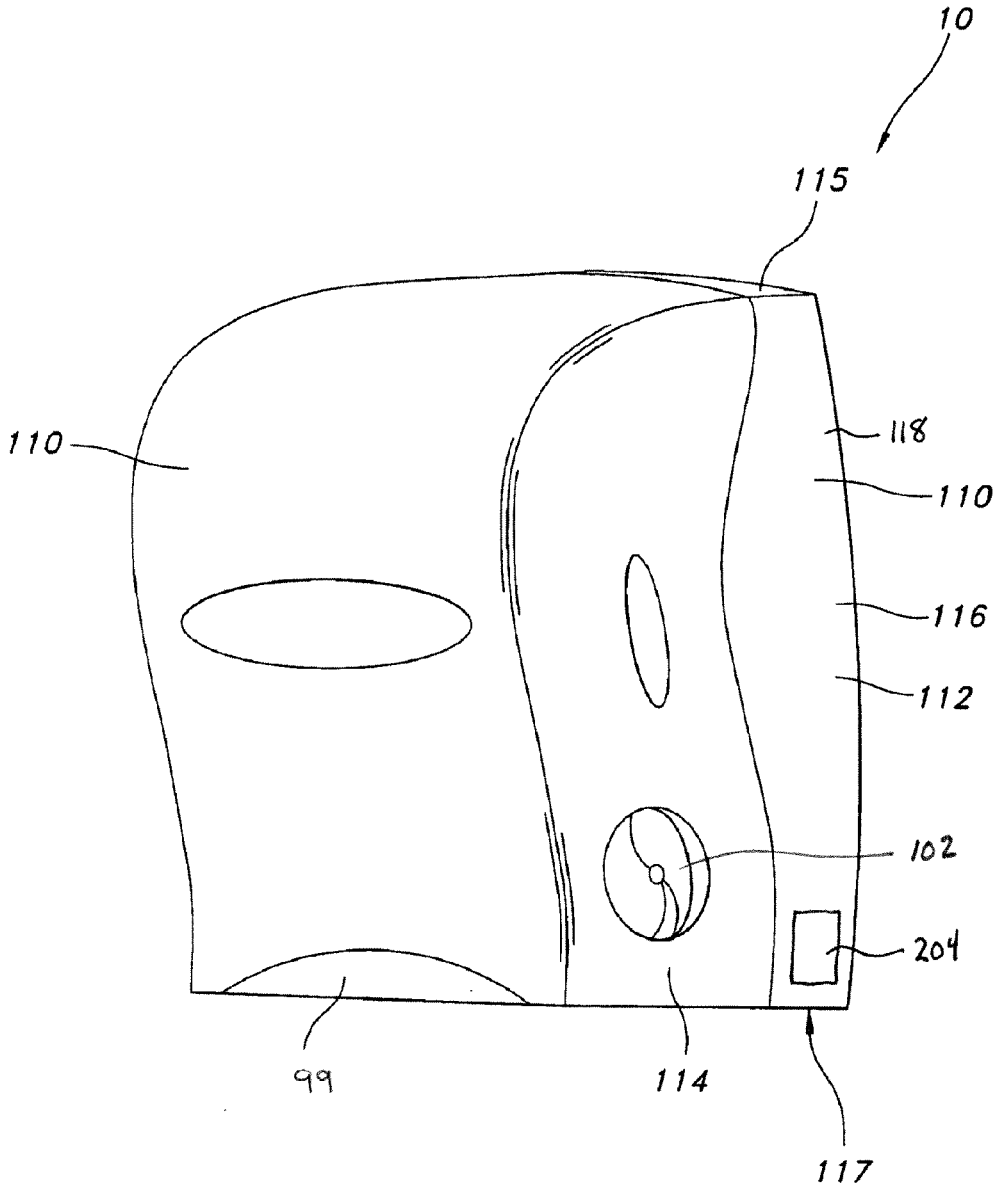
FIG. 1 shows an exterior perspective view of an embodiment of a dispenser according to the invention.

It should be noted that, when employed in the present disclosure, the terms "comprises", "comprising" and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As used herein, the term "sheet" means a defined length of web material dispensed from the dispenser.

As used herein, the term "web material" means the material which is to be dispensed from the dispenser of the present invention prior to forming a sheet. The web material may be rolled onto a roll or may be partially unwound from the roll.

DETAILED DESCRIPTION OF THE INVENTION

In the following detailed description of the present invention, reference is made to the accompanying drawings which form a part hereof, and which shows by way of illustration, specific embodiments in which the invention may be practiced. These embodiments are described in sufficient detail to enable those skilled in the art to practice the invention, and it is to be understood that other embodiments may be utilized and that mechanical, procedural, and other changes may be made without departing from the spirit and scope of the present invention. The following detailed description is, therefore, not to be taken in a limiting sense, and the scope of the present invention is defined only by the appended claims, along with the full scope of equivalents to which such claims are entitled.

The present specification is organized to explain the mechanical features of the dispenser and how they operate. After this explanation, the specification describes the electronic aspects of the dispenser and how they operate the mechanical systems.

The dispenser of the present invention is generally used for dispensing a rolled web material. Such rolled web material may include, but are not limited to, woven materials, non-woven materials, synthetic materials, natural materials, foils, polymer films, any combination thereof, and so forth. The rolled web material is dispensed from the dispenser as a defined length sheet of the web material cut or otherwise removed from the roll of the web material. Specific examples of the web materials which may be dispensed from the dispenser of the present invention include, but are not limited to, absorbent sheet materials such as towels, wipers, tissue, and so forth. The web materials for which the present invention is suitable may be wound around a core (not shown). Alternatively, the web materials are wound into a coreless roll. Optionally, but not required nor preferred, the rolled web material which may be used in the dispenser of the present invention may have regularly spaced zones of weakness extending substantially across the width of the sheet material. The zones of weakness are used to separate or cut the sheet material into individual sheets and may be, for example, defined by a series of perforations, a zone of much lower basis weight, and so forth. Typically, the web material dispensed from the dispenser of the present invention does not contain a zone of weakness, since the cutting blade will cut the web material. In one particular embodiment of the present invention, the dispenser is for dispensing sheets of a paper towel from a roll of a material suitable for use as a paper towel.

Figure 2:
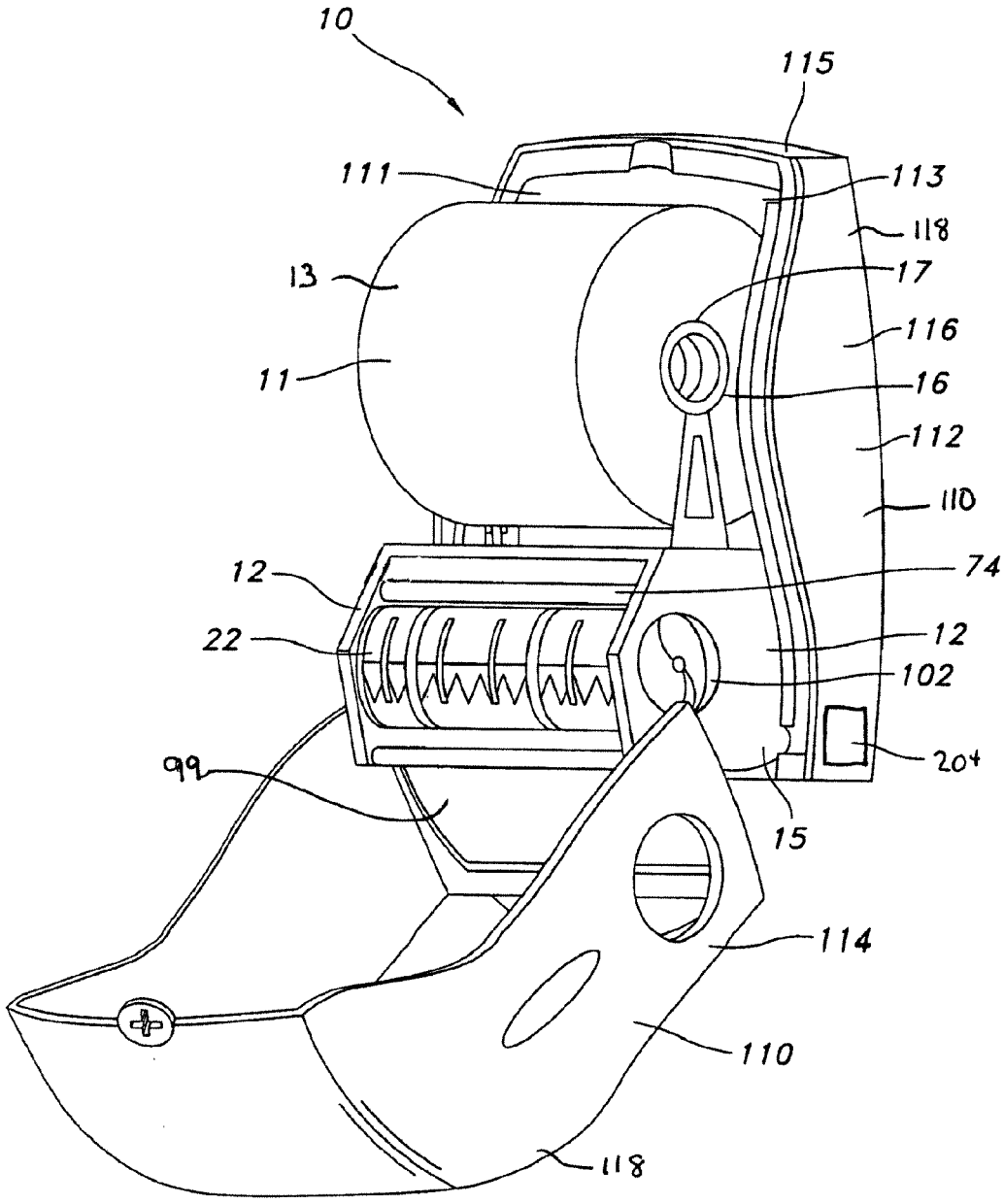
FIG. 2 shows a perspective view of a dispenser of an embodiment of a dispenser according to the present invention, with the front housing in an open position to view the compartment of an embodiment of a dispenser according to the present invention.

Turning to FIGS. 1 and 2, a dispenser 10 within the scope of the present invention will have a dispenser housing 110, also known as a "cabinet". This housing 110 serves to hold and protect the internal workings of the dispenser 10 and the roll 11 of web material 13 which is to be dispensed from the dispenser. The housing will have an outer surface 118. Typically, the housing 110 will have a rear housing section 112, also referred to herein as the "rear housing", and a front housing section 114, also referred to herein as the "front housing". The rear housing may have a rear wall 113, top wall 115, sidewalls 116 and a bottom wall 117. Generally, the front housing 114 may be pivotally connected to the rear housing 112 to provide access to the internal compartment 111 thereby providing a maintainer of the dispenser 10 a means to service or refill the dispenser 10. As is shown in FIG. 2, the front housing 114 is pivotally connected to the rear housing 112 near the bottom wall 117 of the rear housing 112. In alternative embodiments of the present invention, which are not shown in the drawings, the front housing 114 could be pivotally mounted to one of the sidewalls 116 or to the top wall 115 of the rear housing. Alternatively, the front housing 114 could be completely removable from the rear housing 112 to provide access to the internal compartment 111 thereby providing a maintainer of the dispenser 10 a means to service or refill the dispenser 10.

The rear housing section 112 provides means for attaching the dispenser 10 of the present invention to a vertical surface, such as a wall. Generally, the rear wall 113 of the rear housing 112 will be used to attach the dispenser 10 to a vertical surface, such as a lavatory wall, kitchen wall and the like, in the case that the dispenser 10 is a paper towel dispenser. That is, the rear 113 wall also serves as the mounting means for the dispenser 10. Any known attachment means can be used to attach the dispenser of the present invention to a vertical surface, including screws, adhesives, combinations thereof and the like.

The housing 110 of the dispenser may be formed from a wide variety of materials and is not limited in its construction. Generally, the materials used to prepare the housing should be selected on the basis of durability, providing impact resistance and wear and tear during normal usage. For example, the housing may be prepared from metal, plastic or combinations thereof, so long as the housing is durable. It is also noted that the front housing section 114 and the rear housing section 112 may be prepared from same materials or from different materials. In addition, the dispenser housing 110 of the present invention may have any shape, configuration, color or other aesthetic appearance other than is shown in the Figures of the present specification.

The dispenser 10 also has a dispensing opening 99 located in the front housing section 114. Alternatively the dispensing opening may be formed by a gap between the front housing section 114 and the rear housing section 112. The purpose of the dispensing opening 99 is to provide a means for the web material 13 to exit the dispenser 10. The web material 13 is fed through the dispensing opening 99 to the exterior of the dispenser, making the web material accessible to a user.

The housing 110 of the dispenser 10 forms an internal compartment 111 which contains the operating mechanisms of the dispenser 10. The operating mechanisms of the dispenser may be located in a dispensing module 12, which may be operatively mounted and secured to the housing 110, as is shown in FIG. 2. Generally, the dispensing module 12 is secured to the housing by screws, snaps, dove tail style post and grooves or other suitable mechanical fasteners.

In an embodiment of the present invention, to hold a roll 11 of the web material 13 that is to be dispensed from the dispenser 10, a roll holder, also referred to as roll supports 14 (shown in FIG. 3), 16, is operatively associated with the dispensing module 12 to rotatably support a roll 11 of a web material 13. More particularly, now referring to FIGS. 2 and 3, the roll supports 14, 16 generally will include two double-ended arms spaced from one another and roll engagement members 18 at the distal or upper ends 17 of the arms for entering the ends of the roll 11. Roll 11 is directly rotatably supported by the roll engagement members 18. The roll engagement members 18 may include a support roller (not shown).

The roll support arms 14, 16 may be pivotally connected to dispensing module 12 by pivot connectors 20. The pivot connectors 20 are located near the lower end 19 of each roll support arm 14, 16. The pivot connectors allow the roll support arms 14, 16 to be moved outwardly so that the engagement members 18 can be inserted into the ends of the roll 11 of web material 13. Generally, the weight of the roll 11 of web material 13 will exert forces on the arms 14, 16 continuously urging the engagement members 18 of the arms 14, 16 toward one another and toward the roll of paper toweling. Alternately, roll support arms, 14, 16, may be formed to be inwardly biased toward the roll 11 and be formed from a flexible material, such as plastic, such that they may be spread to load the roll of material and when released move back in toward the roll 11 to maintain engagement members 18 in contact with the roll 11 of the web material 13. This prevents dislodgment of the roll 11 from the roll engagement members 18 during dispensing of the web material from the dispenser. The roll 11 of web material 13 may optionally have a roll core (not shown) in which the roll engagement members 18 engage rather than the web material 13. This core may also function as a support roller for the roll 11.

In an alternative embodiment of the present invention, the roll support arms may be pivotally connected to the rear housing 112 rather than the dispensing module 12. Generally, when attached to the rear housing 112, the roll support arms function in a similar manner, as is described above.

Figure 3:
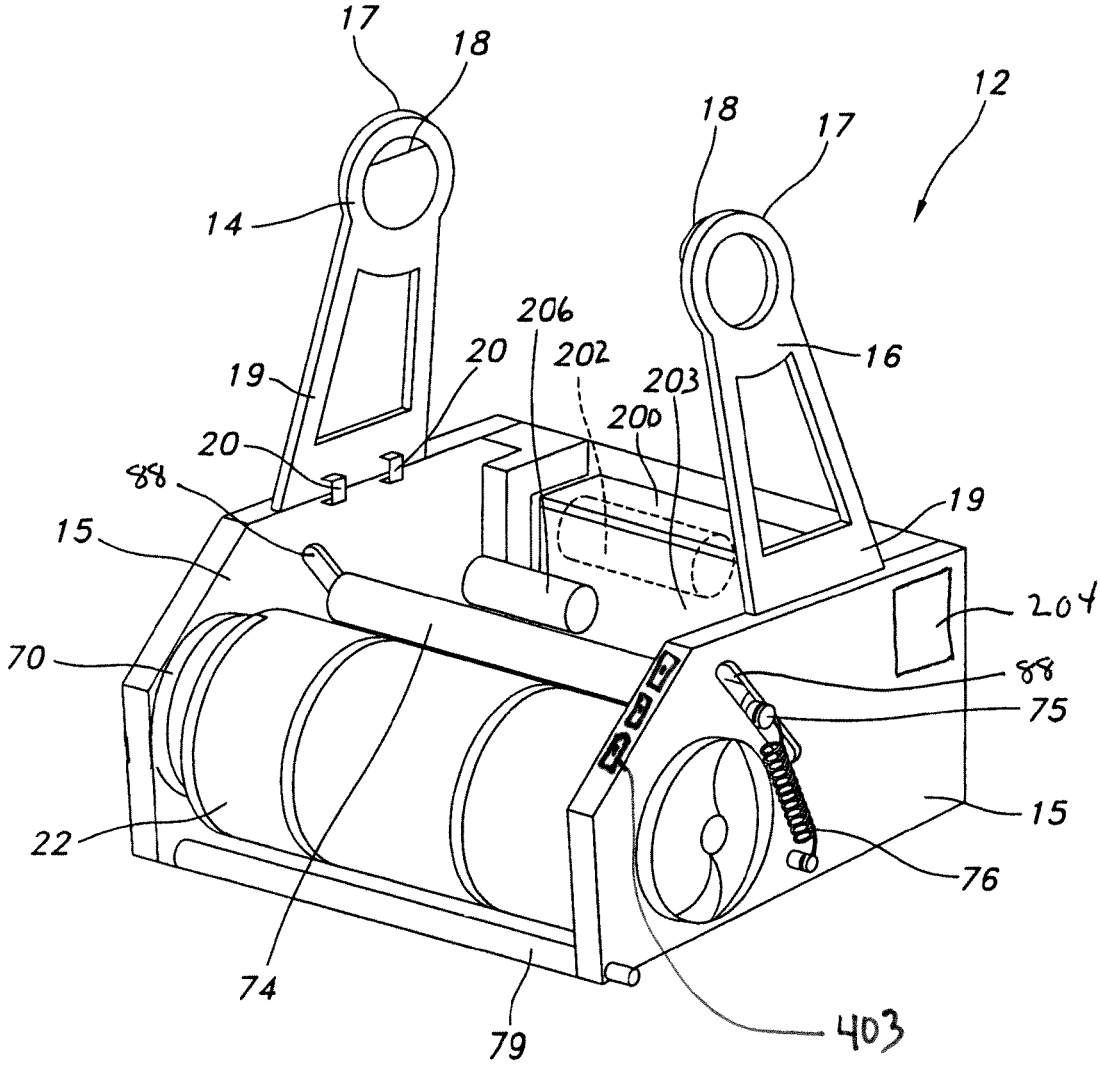
FIG. 3 shows a side perspective view of a dispensing module with rollers present, wherein the dispensing module is shown outside the housing.
Figure 4A:
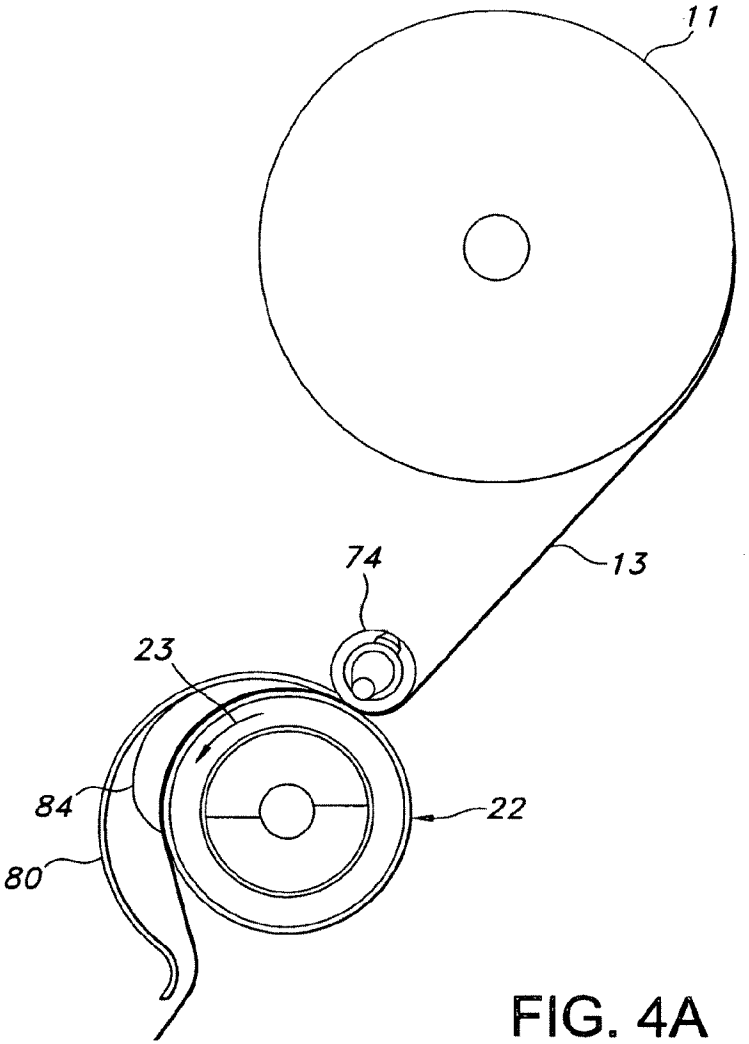
FIGS. 4A and 4B each show the web material fed from the roll to the actuator roller.
Figure 4B:
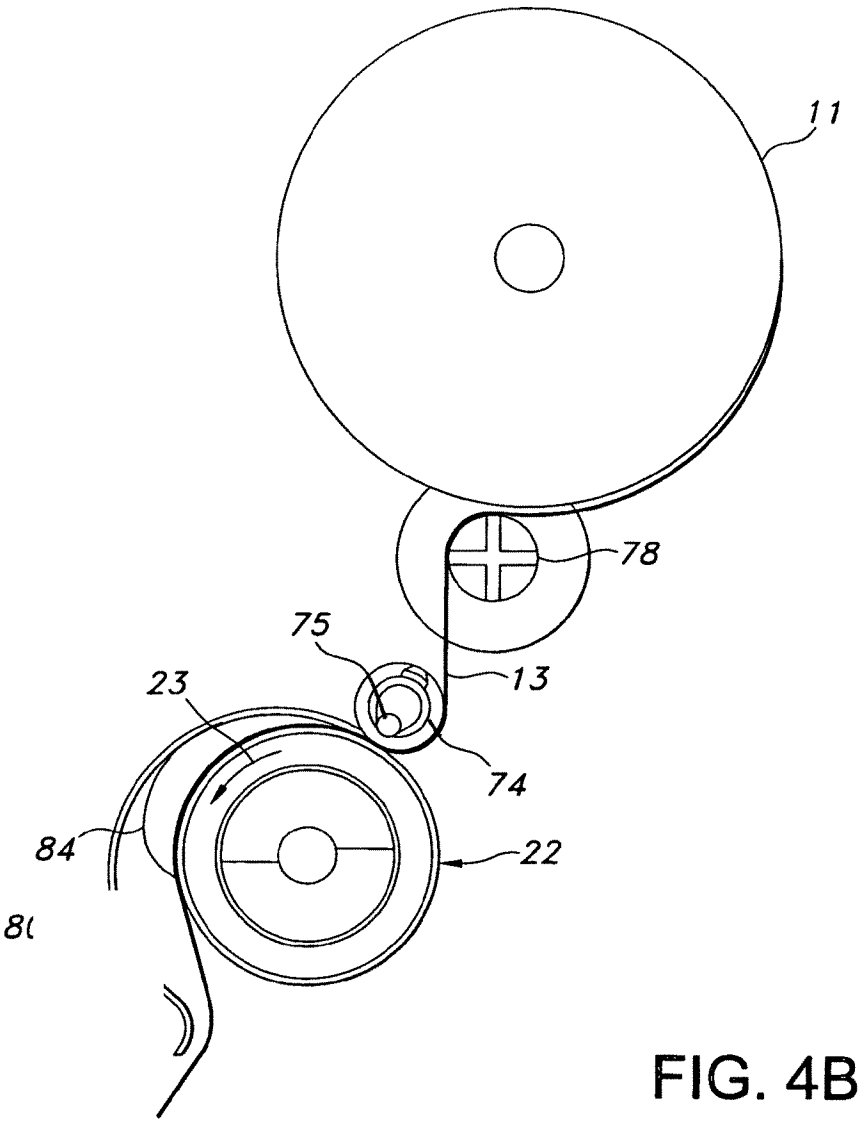

A dispensing actuator roller 22 is rotatably mounted within the compartment 111. The actuator roller 22 generally has a cylindrically-shaped outer peripheral portion and is rotatable in a predetermined direction of rotation. Generally, the dispensing actuator roller 22 is mounted within the dispensing module 12, as is shown in FIGS. 2 and 3. The actuator roller 22 is spaced apart from the roll support arms 14 and 16, such that roll 11 of the web material 13 is fed from the roll over the actuator roller 22, as is shown in FIG. 4A or 4B.

The actuator roller 22 will be described below, and will be described as having many different features. It is intended that these features are described as embodiments that can be used to prepare a dispenser 10 within the scope of the present invention and are not intended to limit the actuator roller 22 to one having each and every one of these features. These features are intended to be merely exemplary of features that may be present on the actuator roller 22.

Figure 6:
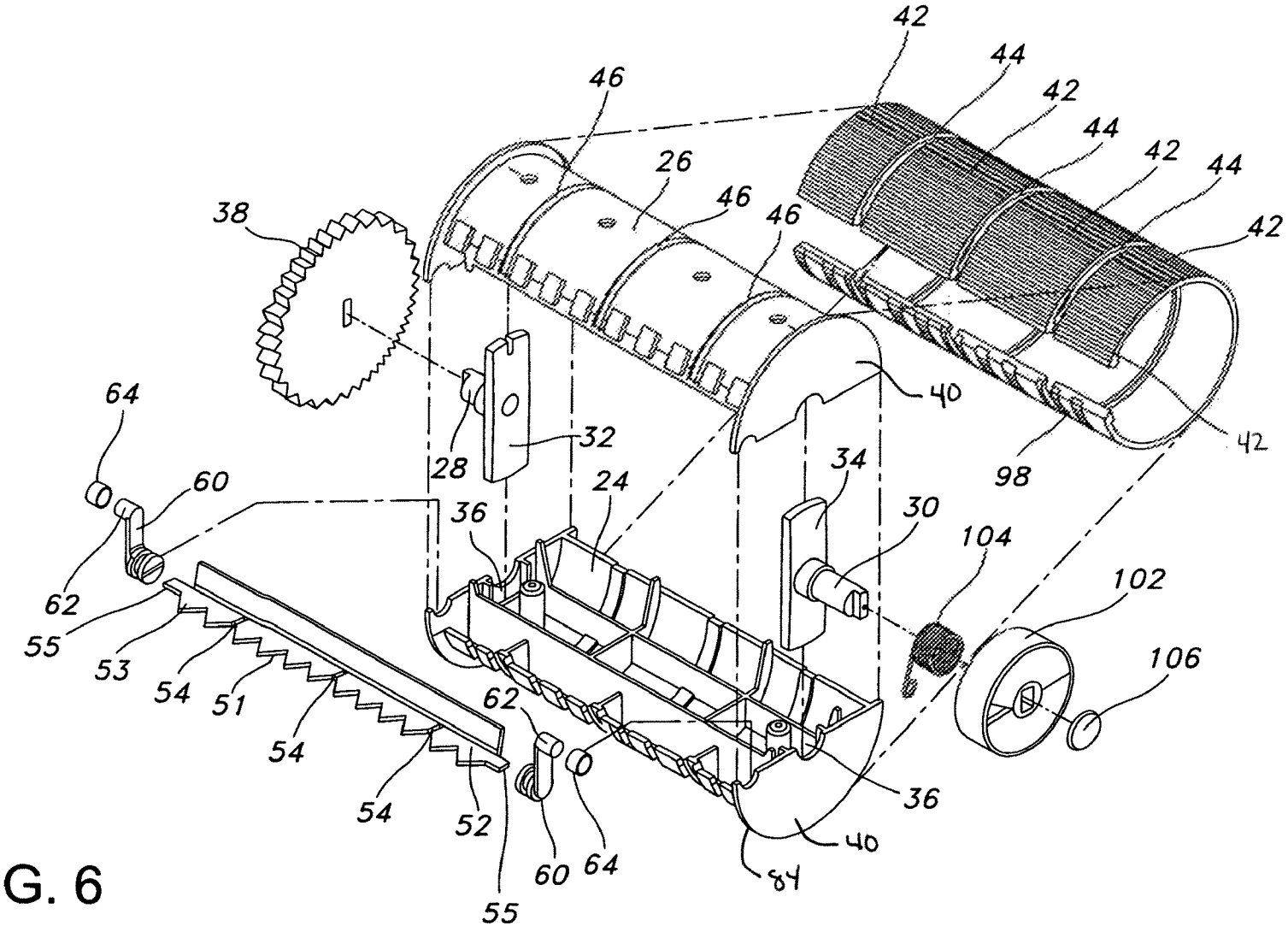
FIG. 6 shows an exploded view illustrating the cutting blade in the actuator roller of an embodiment of a dispenser according to the present invention.

In one embodiment of the present invention, as can be seen in FIG. 6, the actuator roller 22 may optionally be prepared as two roller halves 24, 26 which are assembled together. Alternatively, the actuator roller 22 may be prepared as a single piece or may be prepared from more than two pieces. Shafts 28, 30 may be attached to mounting plates 32, 34, respectively, the mounting plates inserted in recesses 36 located at the ends of the roller halves 24, 26 to lock the shafts 28, 30 in place. This will cause the shafts 28, 30 to rotate with the rest of the actuator roller 22 structure. In an alternative embodiment, shafts 28 and 30 may be prepared as a single shaft which extends through the entire length of the actuator roller 22. The shaft or shafts 28, 30 serve to rotatably mount the actuator roller 22 in the dispensing module 12. Generally, the shafts are located along the center axis of the actuator roller 22 so that the actuator roller rotates evenly when rotated. An actuator roller drive 38 may be connected to the distal end of shaft 28. Alternatively, the actuator roller drive 38 may be located on the proximate shaft 30. In essence, it is not critical to the present invention on which shaft the roller drive 38 is located. Alternatively, the actuator roller drive 38 could be one of the end plates 40 of the actuator roller 22, which are described in more detail below. The actuator drive roller 38 serves to transfer the rotation force provided by a motor 206 (shown in FIG. 3) to the actuator roller 22. The actuator roller drive 38 may be a gear, as shown in FIG. 6, or may be any other known structure which will enable a motor or another drive to rotate the actuator roller 22, including, but not limited to a pulley and a belt.

Generally, the ends of actuator roller 22 may have end plates 40 (see FIGS. 5A and 6) which form central openings or apertures 36 accommodating the shafts 28, 30. As is stated above, the end plates 40 may also be formed such that the end plates 40 may also function as the actuator roller drive 38. The cylindrically-shaped outer portion of the actuator roller 22 may include strips of a material 42, which is generally a material such as rubber or plastic that provides a fairly high coefficient of friction. Alternatively, the actuator roller 22 may be prepared from any other suitable material which has a fairly high coefficient of friction. By having a fairly high coefficient of friction, the actuator roller will be provided with the ability to contact and hold the web material 13, as it is threaded over the actuator roller 22 and during operation of the dispenser 10. In one embodiment of the actuator roller 22 usable in the present invention, the strips of material 42 are wrapped about the assembled actuator roller halves 24, 26. These strips of material 42 may be applied to the assembled actuator roller to define parallel, spaced channels 44. More particularly, the strips 42 may be located adjacent double ribs 46 formed on roller halves 24, 26 to form the channels. The strips of material 42 do not need to extend all the way about the assembled roller halves. Any suitable means may be employed to secure the strips of material to the roller halves. In one embodiment, the strips 42 may be coated on the roller halves 24, 26, adhesively applied to the roller halves 24, 26 or mechanically attached to the roller halves 24, 26.

The actuator roller 22 has a pivotally mounted cutter blade 52 housed within the actuator roller 22. The cutter blade 52 typically will have a plurality of triangular-shaped teeth 53 along an edge 51 thereof. Cutter blade 52, in this configuration is pivotally connected to the actuator roller 22, in particular about a pivot point located near an outer portion of the cylindrically-shaped actuator roller 22. By having the cutter blade 52 pivotally mounted in the actuator roller 22, the cutter blade 52 can be designed to extend outward from the actuator roller 22 to cut the web material 13 into an individual sheet for use by a user at a certain point in the rotation of the actuator roller 22. Alternatively, the cutter blade 52 may only cut the web material 13 to a degree that a individual sheet is not cut completely free from the web material, but to a degree that a user pulling on an exposed portion of the web material will cause the individual sheet to become free from the web material.

In addition, the cutter blade 52 may have a plurality of recesses 54 may extend inwardly from the teeth 53 and between sets of teeth 53. These recesses 54 generally align with the channels 44 in the actuator roller 22. That is, the cutter blade teeth 53 do not extend from the actuator roller 22 in the channels 44 found in the actuator roller. Cutter blade 52 has cam followers 60 attached to each end 55 of the cutter blade 52. Optionally, each cam follower 60 has a cam follower arm 62 and a roller 64 positioned on the follower arm 62, as is shown in both FIGS. 5A and 6. The rollers 64 aid in prevention wear of the cam follower 60 or follower arm 62. Each roller 64 is located externally of an end plate 40 and rides in a channel 66 of each cam 70 (shown in FIG. 3). Cams 70 are located at both ends of the dispensing module frame 15. The rollers 64, if present, or the cam follower arms 62 are positioned in the cam and follow the cam 70 during rotation of the actuator roller 22.

Figures 5A, 5B:
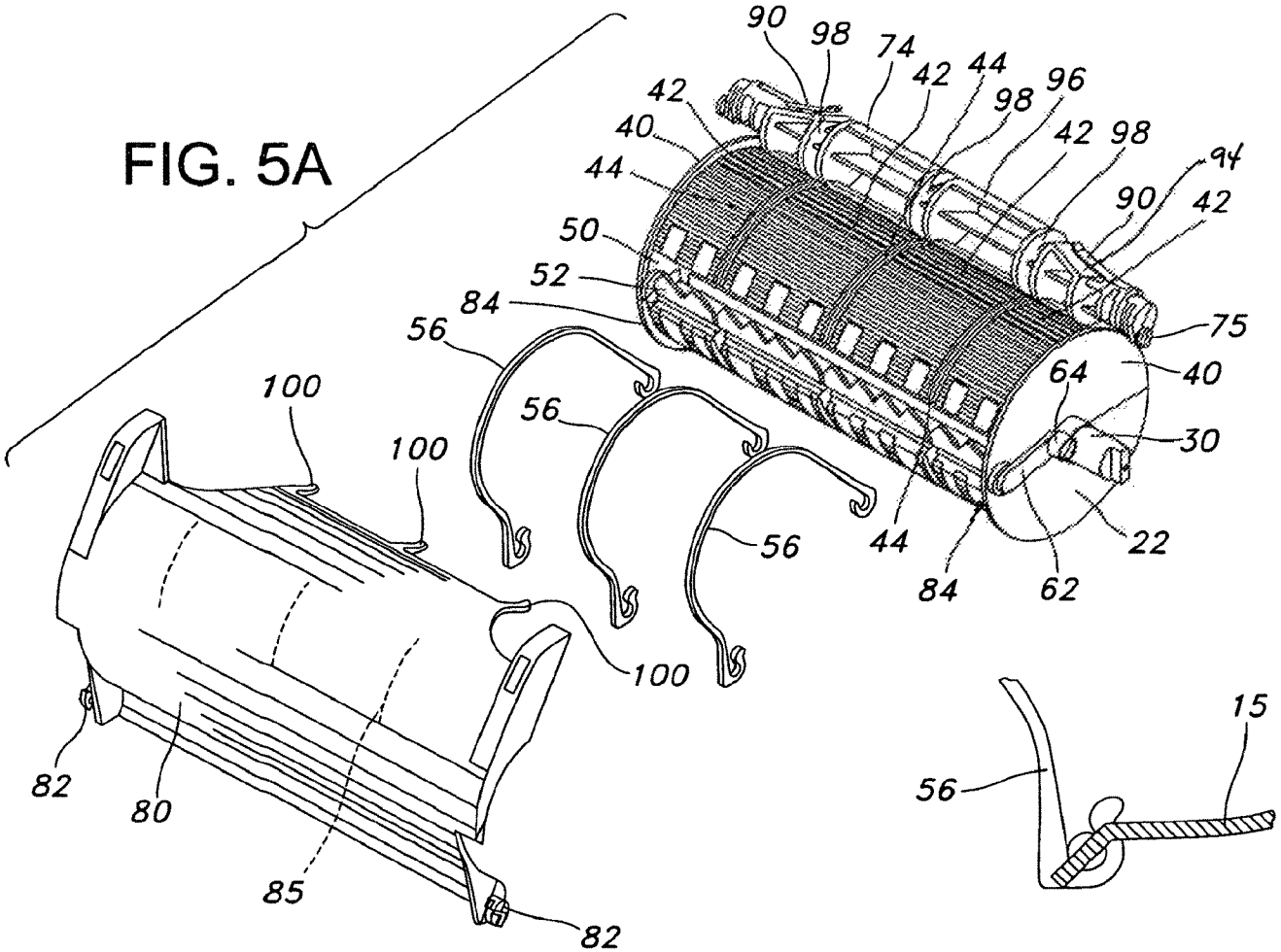
FIG. 5A shows an exploded view illustrating selected components of the apparatus
FIG. 5B shows an enlarged side view illustrating a portion of a guide clip element of the dispenser connected the dispensing module usable in an embodiment of a dispenser according to the present invention.

Channels 44 in the actuator roller 22 may be provided to accommodate a plurality of guide clips 56. The guide clips remain stationary during rotation of the actuator roller 22, and are present to guide the web material 13 from the roll 11 onto the actuator roller 22. The guide clips 56 may be prepared from a variety of materials including metal and plastic type materials. The guide clips 56 are slightly narrower than the channels 44 in the actuator roller 22 and the guide clips are spaced apart from the channels 44 in the actuator roller 22 so that the actuator roller 22 will freely rotate on its axis. The guide clips 56 may be generally configured to have a hooklike configuration, as is shown in FIG. 5B, which allows the guide clips 56 to attach to the dispensing module frame 15.

A guide roller or tensioning device 74 may be also mounted in the dispensing module frame 15. Generally, the guide roller or tensioning device will be rotatably mounted in the dispensing module frame 15. The guider roller or tensioning device 74 will serve to guide the web material 13 from the roll 11 to the actuator roller 22, as is shown in FIG. 4A. This guide roller or tensioning device 74 may be positioned next to the actuator roller 22 and can be biased against the actuator roller using a biasing device 76 such as a spring, o-ring bands and the like. Generally, the biasing may be accomplished by attaching the biasing device to the end 75 of the guide roller or tensioning device 74 and to the dispensing module frame 15, as is shown in FIG. 3. The guide roller or tension device 74 will generally be cylindrical in nature.

During operation of the actuator roller, it is desirable that the guide roller or tensioning device 74 not contact the cutter blade 52 which may be present in the actuator roller 22. Contact between these elements may result in damage to the cutting blade 52 or the guide roller or tensioning device 74. Damage to one or both of these elements may result in unwanted damage to the web material 13 or make the dispenser 10 unusable for its intended function. To prevent this unwanted interaction between the cutting blade 52 and guide roller or tensioning device 74, the guide roller or tensioning device ends 75 are positioned in slots 88 located in both sides of the dispensing module frame 15. This will allow the guide roller or tensioning device 74 to be displaced by some mechanism as the cutter blade 52 of the actuator roller 22 becomes adjacent to the guide roller or tensioning device 74. One way to cause the guide roller or tensioning device 74 to be displaced is to have protrusions 84 located on the actuator roller 22. One possible location for these protrusions 84 is on the ends 40 of the actuator roller 20, as is shown in FIG. 5A. Generally, these protrusions 84 will be located near the cutter blade 52. However, other methods of displacing the guide roller or tensioning device 74 may also be used without departing from the scope of the present invention. Alternately, one or more guide or tensioning rollers 74 may be configured in a segmented manner wherein segments in contact with actuator roller 22 pass between the teeth 53 on cutter blade 52 and do not contact the cutter blade. The protrusions 84, may serve as web control members 85, which are describe below. Another way to prevent the cutter blade 52 from contacting the guide roller or tensioning device 74 is to simply have the cutter blade 52 cammed such that the cutter blade 52 is within the actuator roller 22, when the cutter blade 52 passes the guide roller or tensioning device 74.

The dispenser 10 of the present invention may also have a guiding plate 80 which is employed to cover the actuator roller 22 and to provide guidance to the web material 13 being dispensed from the dispenser 10. This guide plate 80 may be pivotally mounted to the dispensing module frame 15 using pivot pins 82. Alternatively, the guide plate 80 may be removably mounted without the use of pivots. By having the guide plate pivotally or removably mounted to the dispensing module frame 15, the guide plate 80 may be removed for servicing the actuator roller 22, cutting blade 52 or other parts of the dispensing mechanism. The guide plate may also be provided with fingers 100 which extend over the channels 44 in the actuator roller 22. As is shown in FIGS. 5A and 4A, the guiding plate 80 may also have web control members 85 which cause the web material 13 to remain in contact with the actuator roller 22 as the cutter blade 52 is extended from the actuator roller 22. The web control member 85 may function the same as the protrusions 84 described above. The web control members 85 are positioned over the guide clips 56 so that they will come into contact with the guide clips 56. This will prevent the web control members 85 from becoming damaged during use of the dispenser, since the teeth 53 of the cutter blade 52 are not present in the channels 44 where the guide clips 56 are positioned.

The dispenser of the present invention also has a power supply 202 which is capable of powering a motor 206, and a control circuit 400 (not shown in FIG. 3), but is discussed in more detail below. Generally, the power supply 202 is located in a power supply compartment 200, which will serve to isolate the power supply 202 from the remaining components of the dispenser 10. Generally, the power supply 202 is located within the compartment of the dispenser. The control circuit 400 completes an electrical connection between the power supply 202 and the motor 206, causing power to be supplied from the power supply 202 to the motor 206, thereby activating the motor. Depending on the mode of operation, the control circuit 400, activates the motor 206 after receiving a signal from a sensor which is discussed in more detail below. The operation of the dispenser and the function of the control circuit 400 are also discussed in more detail below.

As mentioned, a power supply 202 may be contained within the compartment of the dispenser 111 or the housing 110. The power supply 202 stores and supplies power to the motor 206 and any other control circuitry present in the dispenser. The power supply 202 may include a removable battery compartment 203', shown in FIG. 14A-C, for disposable DC batteries. Alternatively, the power supply 202 may be a closed system which requires that the entire power supply be replaced as a single unit. Although not shown in the figures, an AC to DC adapter may be utilized to provide an alternate source of power to the dispenser 10. This embodiment may be particularly useful wherein the dispenser 10 is mounted in close proximity to an AC outlet or when it is desirable to power multiple dispensers from a centrally located transformer of suitable configuration and power. The number of batteries used to power the motor will depend on the motor selected for the dispenser. Disposable batteries useable in the present invention include 9 volt batteries, 1.5 volt batteries, such as D-cell or C-cell batteries, or other similar batteries. The exact type of battery selected for use is not critical to the present invention so long as the power supplied to the motor 206 is compatible for the motor 206. For applications where the dispenser 10 will be used under low usage situations, rechargeable batteries could be used. If the dispenser 10 is to be used in a bright light situation, the batteries could be solar rechargeable batteries. The power supply compartment 200 may be configured to be positioned in the dispensing housing frame 15, as is shown in FIG. 3, or may be attached to the rear housing 112. The location of the power supply compartment 200 is not critical, but should be located such that the power supply 202 can be easily replaced, when needed. Also the location of the power supply compartment should be selected that power supply compartment does not interfere with the roll of the web material to be dispensed from the dispenser or other operation portions of the dispenser.

In the present invention, where the power source 202 contains batteries, the batteries in the battery compartment 203 may be accessible from inside the internal compartment 111 of the dispenser 10 or may be accessible through an access opening 204 located in and through the external surface 118 of the housing 110 of the dispenser 10 and the dispensing frame module 15, as is shown in FIGS. 1-3. The access opening 204 may also have a locking mechanism that will require a special tool or key to open the access opening 204, to prevent the batteries from being removed by unauthorized personal, such as the users of the dispenser. By having the access opening 204, a person providing service to the dispenser will be able to change the batteries without the need to open the dispenser to access the internal compartment 111 and battery compartment 203 only accessible from the internal compartment of the dispenser. Often, if the roll 11 of web material 13 is in the compartment and on the roll support, with only access to the battery compartment 203 through the internal compartment 111 of the dispenser 10, it may be necessary to remove the roll 11 of web material to install fresh batteries. As a result, added time and labor is necessary to maintain the dispenser.

Figure 14B:
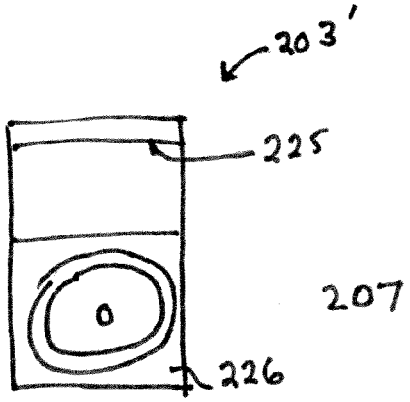
FIGS. 14A, 14B and 14C each show a removable battery compartment within the scope of the present invention.
Figure 14A:
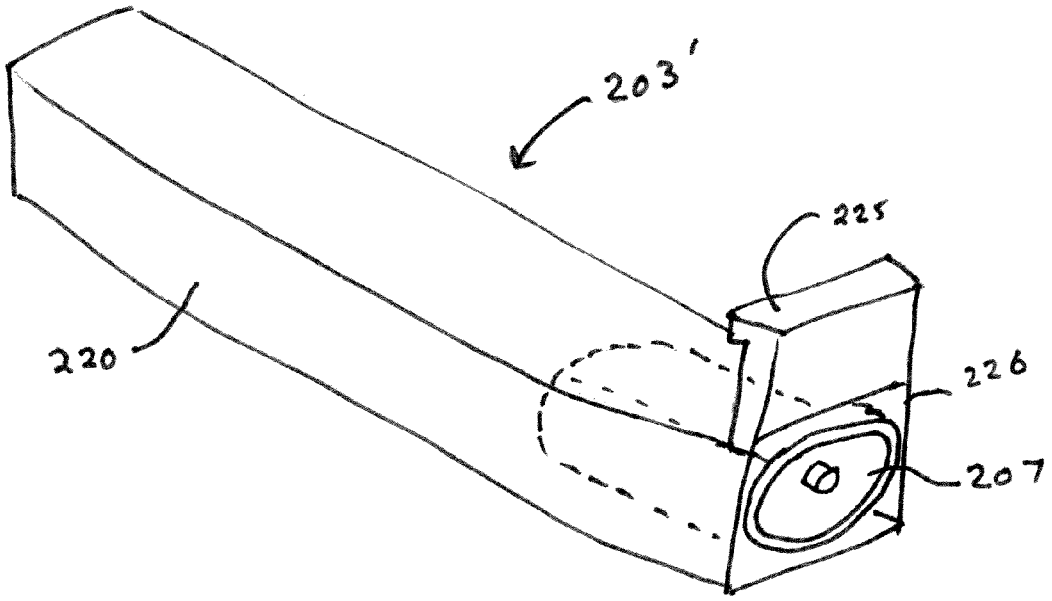
Figure 14C:
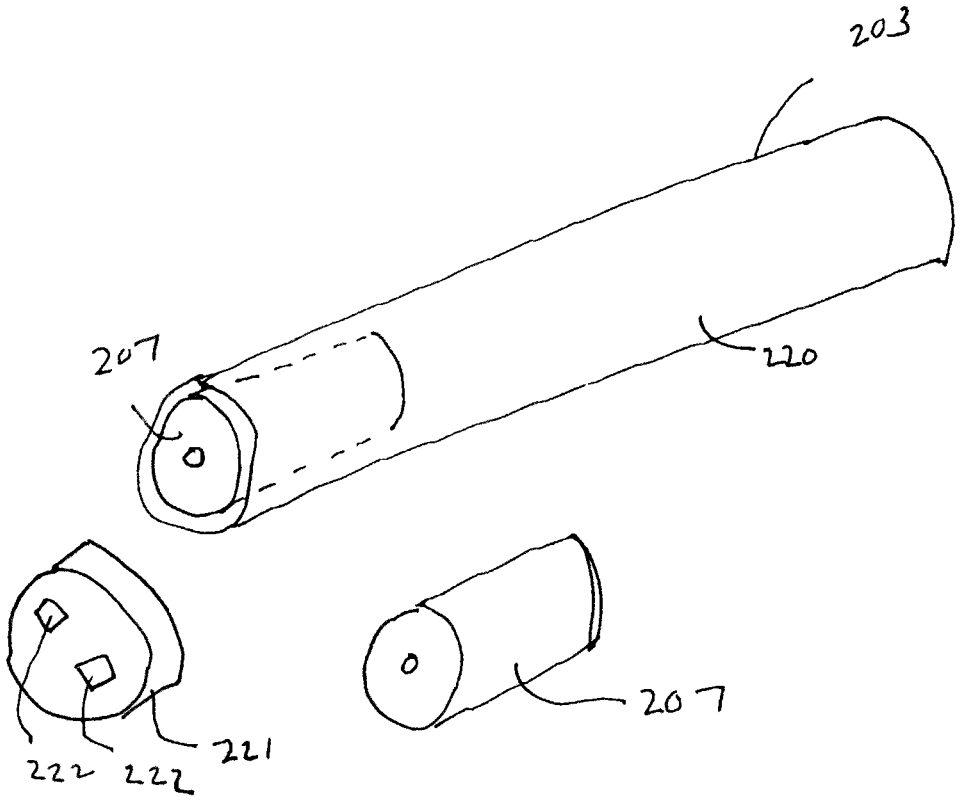

Alternatively, the battery compartment 203 may be a removable battery compartment 203' which is completely removable from the internal compartment 111 of dispenser 10. By having a removable battery compartment 203', it can be easier for the maintainer of the dispenser to install replacement batteries. The removable battery compartment 203', will hold the batteries in position so that the batteries can all be installed at once, rather than installing the batteries one at a time. Often in can be difficult to replace batteries in a dispenser on a wall since the batteries may be at a level which makes it difficult for the maintainer to hold batteries in place while additional batteries are installed. Often spring like structures are used to hold batteries in contact with electrical pick-ups. The maintainer will have to carefully manipulate the batteries in place to counter act the compression cased by the spring. An embodiment of the removable battery compartment is shown in FIGS. 14A and 14B. In this embodiment, the removable battery compartment 203' is removed from the internal compartment 111 with the batteries 207 contained within the compartment 203. The removable battery compartment 203' has a battery compartment housing 220. In addition, the removable battery compartment 203' may have a grip 225, which will allow the maintainer of the dispenser 10 to remove the removable battery compartment 203'. The battery compartment housing 220 and may optionally have a removable access panel 221 shown in FIG. 14C. Once the removable battery compartment 203 is removed from the dispenser 10, the access panel 221, if present, is removed from battery compartment housing 220, to exposed the used batteries. New batteries 207 are then installed into the battery compartment housing 220 and the battery access panel 221 is replaced onto the battery compartment housing 220. Generally, the battery access panel 221 may be held in a place with a connection mechanism, such a threads, a tab and catch or other similar means to hold the battery access panel 221 to the battery compartment housing 220. Once the access panel is in place, the battery compartment 203 is returned to the dispenser 10. In the removable battery compartment 203 embodiment, the battery compartment, one or both of the battery compartment housing 220 and the battery access panel 221 may have contacts 222, which will complete the electrical connection with between the batteries 207 and the electronics of the dispenser. Alternatively, the battery compartment housing may open ends 226 where the batteries themselves make contact with electrical connections, as is shown if FIGS. 14A and 14B. As show in FIG. 14C, the contacts 222, both positive and negative are located on the battery compartment access panel 221. However, this is not intended to be limiting. That is, both contacts could be located on the battery compartment housing 220 or one could be located in the battery compartment housing 220 and one could be located in the battery compartment access panel 222.

Figure 15:
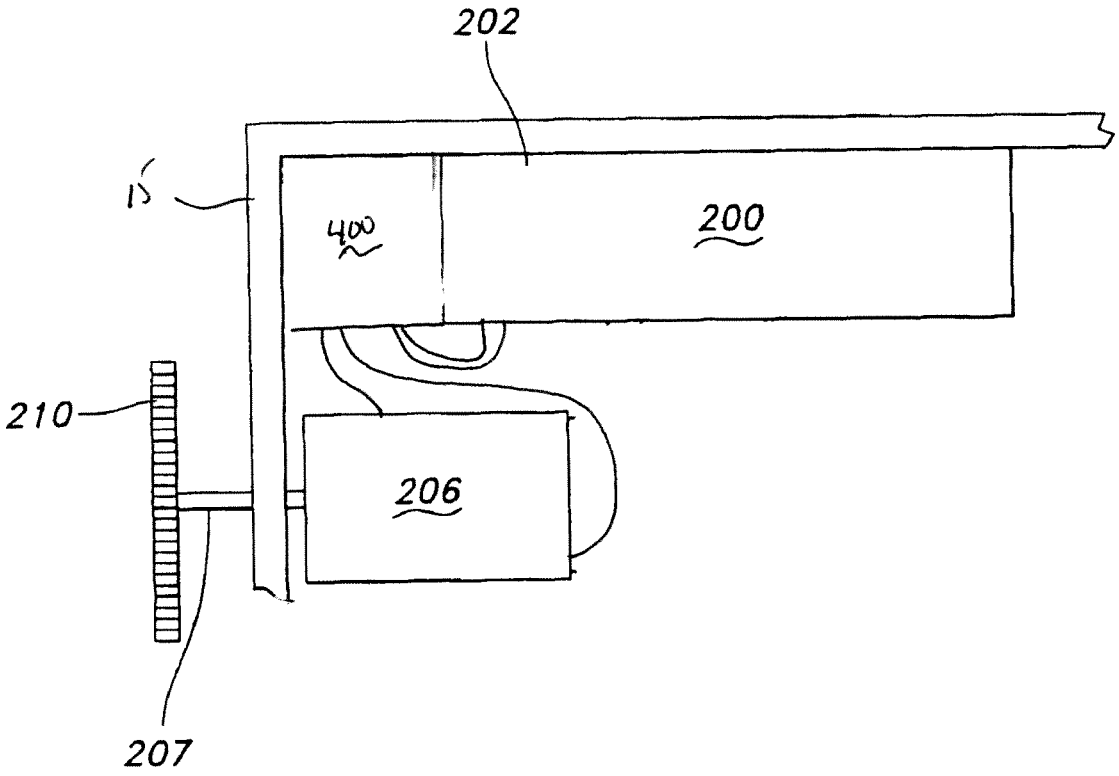
FIG. 15 shows an exemplary configuration of the power supply, control circuit and motor.

The motor 206 is also mounted within the compartment 111 of the dispenser 10. The motor 206 is electrically connected to the power supply 202 through the control circuit 400. Generally, any motor that is electrically activated may be used. Typically, the motor 206 may be a direct current (DC) motor, generally in the 3 volt to 12 volt range. Larger or smaller motors may also be used and it is within the skill of those skilled in the art to select an appropriately sized motor. A typical motor usable in the present invention will have a shaft 207 with a gear 210 extending from one end of the motor 206. Alternatively, a shaft 207 with a gear 210 may extend from both ends of the motor. Generally, the motor 206 may be mounted in the dispensing module frame 15, as is shown in FIG. 15. using any suitable means known to those skilled in the art. Alternatively, the motor may be mounted within the internal compartment 111 outside of the dispensing module frame 15.

Figure 2A:
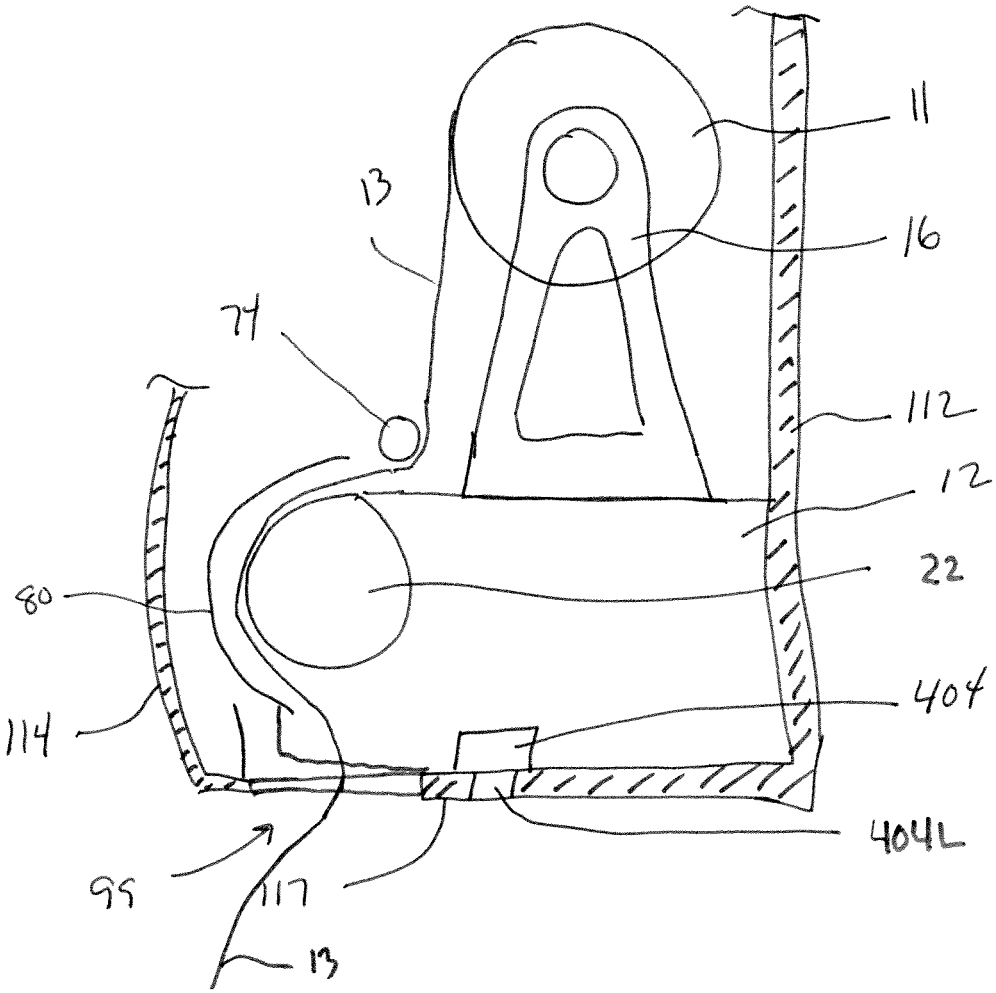
FIG. 2A shows a cut-way cross-section of the dispenser with the module.

The dispenser 10 of the present invention may be provided with an activation sensor 404, which may be mounted to the bottom wall 117 of the housing 110 or may be mounted to the dispensing module 12 at or near the dispensing opening 99. The actual location of the activation sensor is can be varied and could be on the front housing 114. However, since the dispenser 10 is only desired to be operated when a user desires a sheet of the web material, the sensor are generally preferred to be located below the dispenser. The activation sensor may have an adjacent lens 4041, as illustrated in FIG. 2A. It will be understood, however, that the activation sensor 404 and/or lens 4041, or any activations system shown and/or described herein or known in the art, may be mounted in any area of the housing, so long as it operates as described herein. In this embodiment of the invention, the activation sensor is desirably, but not by way of limitation, a conventional passive sensor for detecting infrared radiation. Passive infrared detectors are known in the art, and are described, for example, in U.S. Pat. No. 4,757,337 to Shikaumi and U.S. Pat. No. 4,960, 248 to Bauer et al, both of which are incorporated herein by reference. A passive infrared detector which may be used with the dispenser 10 is a Model 40623 sold by Eltec Instruments Inc. However, those of skill in the art will appreciate that various different infrared detectors are available, and that many of the available detectors are suitable for use with the dispenser 10. In practice, the activation sensor 404 is arranged to detect infrared radiation from a user's hand placed below the lens 4041, and upon detecting the radiation, to transmit a signal to a control circuit 401 for activating the electric motor 206 so as to dispense a length of sheet material through the dispensing opening 99 of the dispenser.

It will be understood, however, that other activation mechanisms, such as capacitive and ultrasonic, may be used in the present invention. Capacitive proximity sensors produce an electrostatic field that will sense both metal objects and non-metallic materials such as paper, glass, liquids and cloth. Ultrasonic proximity sensors use a transducer to send and receive high frequency sound signals. When a target enters the beam the sound is reflected back to the sensor, causing it to energize or de-energize the output circuit. Another sensor type is inductive. In this case an electromagnetic field is used, however, detection is limited to only metallic objects.

The dispenser of the present invention may also be provided with additional features such as an emergency feed mechanism. One such mechanism is shown in FIG. 6, and includes a knob 102 which may be mounted on the one of the shafts 28, 30 associated with the actuator roller 22. In the case shown in FIG. 6, the emergency feed knob 102 is located on the shaft 30 opposite the actuator roller drive 38. The knob 102 could be positioned on the shaft 30 such that the knob 102 will not rotate unless engaged. For example, the knob 102 could be mounted with a biasing device (not shown) which would require the user to push the knob 102 toward the actuator roller 22 or, in the alternative, to pull the knob 102 away from the actuator roller 22 in order to engage the knob with the actuator roller 22. Alternatively, the knob 102 could be configured to be continuously engaged with the shaft 30, so that the knob 102 will rotate with as the actuator roller 22. In yet another embodiment of the present invention, if shafts 28 and 30 are connected and form a single shaft running through the entire length of the actuator roller 22, knob 102 and shafts 28, 30 could be made to be movable along the central axis of the actuator roller 22. In that case, the knob 102 and shaft combination could be used to move the actuator roller drive 38 such that the motor drive gear is disengaged when the knob 102 is rotated. The knob 102 may be held in place with a cap 106. To prevent a user from turning the knob 102 in a direction opposite the normal direction the actuator roller 22 rotates, a one-way clutch 104 may be provided on the actuator roller. As is shown in FIG. 6, the one-way clutch 104 may be located on one of the shafts 30 and can be associated with the knob 102.

Another feature, which is shown in FIG. 5A which may be incorporated in the dispenser of the present invention are clips 90, which may be pivotally connected to the ends of the guide roller or tensioning device 74 and are biased by springs (not shown) to clampingly engage planar surfaces 94 on guide roller or tensioning device 74. The clips 90 aid an attendant to thread the web material through the dispensing mechanism and allow a remainder of a roll of web material to be dispensed, while a new roll of web material is loaded, as is shown in U.S. Pat. No. 6,314,850, which is hereby incorporated by reference in its entirety. Guide roller or tensioning device 74 also has a smoothly rounded wall 96 located between the planar surfaces 94 and may be configured to form peripherally extending grooves 98 which correspond to placement of the channels 44 and guide clips 56. Fingers 100 on guide plate 80 extend into grooves 98.

Other features which may optionally be incorporated into the dispenser of the present invention include an additional guide roller 78, as is shown in FIG. 4B. The additional guide roller may help prevent over spinning of the roll during dispensing and help guide the web material 13 from the roll 11 to the actuator roller. The dispenser of the present invention may also optionally have a dispensing roller 79, located near the dispensing slot 118, as is shown in FIG. 3. These features are explained in more detail in U.S. Pat. No. 7,222,816 issued to Clark, which is hereby incorporated by reference.

To help understand the operation of an embodiment of a dispenser within the scope of the present invention, attention is directed to FIGS. 7-13. FIGS. 7-13 show a full dispensing cycle of a dispenser within an embodiment of the present invention. Under normal manual operation of dispenser 10, the user is presented with a tail 121 of the web material 13 projecting through dispensing slot 118 (FIG. 1) located on the bottom front portion of front housing 114. The user grasps the tail 121 of the web material 13 and pulls the tail 121 from the dispenser using a downward force 122, shown in FIG. 8. This downward force 122 causes the actuator roller 22 to start to move in a rotation direction 123 shown in FIG. 7. The cam follower 60 and cutter blade 52 also follow the rotation direction 123.

During rotation of the actuator roller 22, the cam follower arms 62 or cam roller 64, if present, are caused to move along the cam surfaces within the defining channels 66. This in turn will cause the cutter blade 52 to pivot relative to the actuator roller 22. The cutter blade 52 moves between a first position, shown in FIGS. 7 and 8 to a second position, shown in FIGS. 11 and 12. In the first position, the cutter blade 52 lies substantially flat against the actuator roller 22 or to be positioned within the actuator roller 22 with the cutting or toothed edge 53 of the cutting blade 52 positioned closely adjacent to or within the actuator roller 22. In the second position, the cutter blade 52 is disposed at an angle relative to the outer surface of the actuator roller 22, with the teeth 53 thereof spaced from the actuator roller 22. The cutter blade 52, when in the second position, projects from the pivot in a direction generally opposed to the direction of rotation of the actuator roller 22. This is clearly shown in FIGS. 11 and 12.

Figure 7:
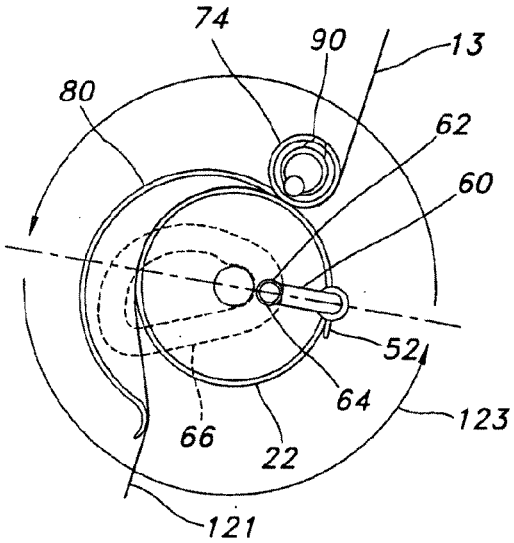
FIG. 7-13 show schematic end views illustrating the cooperative relationships existing between the rotatable actuator roller, cutter blade, cam follower and other structural components of an embodiment of a dispenser within the scope of the present invention during sequential stages of operation of the dispenser. These figures also show a full dispensing cycle of an embodiment of the present invention.
Figure 8:
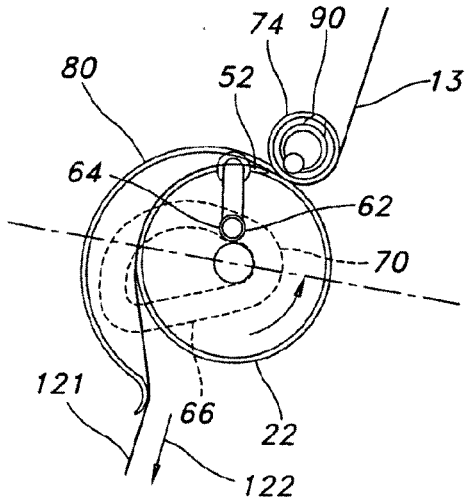

FIGS. 7 through 13 provide an illustration of the action of the cutter blade 52 relative to the actuator roller 22 due to cam actuation. FIG. 7 illustrates by curved arrows 123 the direction of rotation of the actuator roller 22, cam follower 60 and cutter blade 52. FIG. 7 shows the cutter blade 52 in its first position, the position it assumes when the actuator roller 22 is at rest. This is also the initial or rest position for the actuator roller 22, when not dispensing a sheet. The web material 13 from roll 11 is located on and supported by the actuator roller 22, the toweling passing under the guide roller or tensioning device 74 forming a nip with the actuator roller 22. The guide roller or tensioning device 74 may be stationary or may rotate. The guide roller or tensioning device 74 acts to apply pressure to the actuator roller 22 to keep the web material under tension when the web material 13 is being dispensing.

Figure 9:
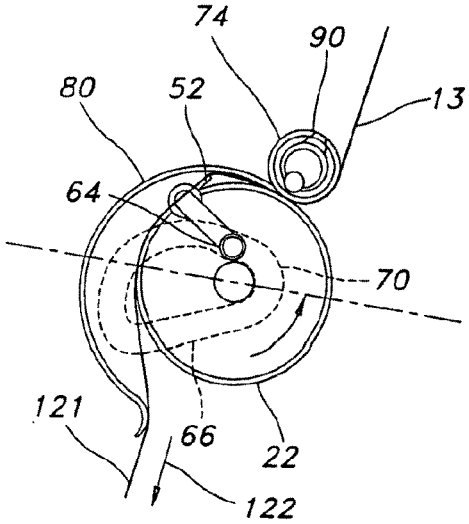
Figure 10:
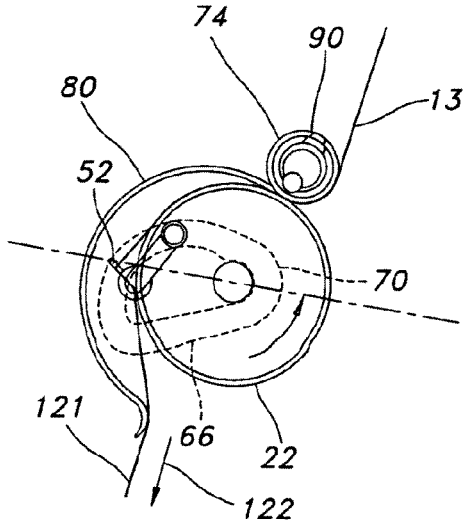
Figure 11:
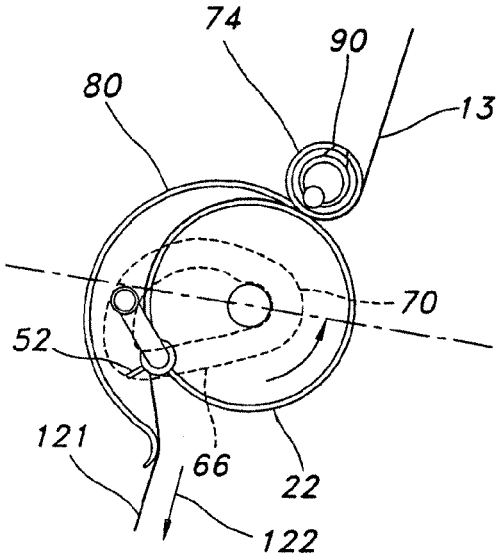
Figure 12:
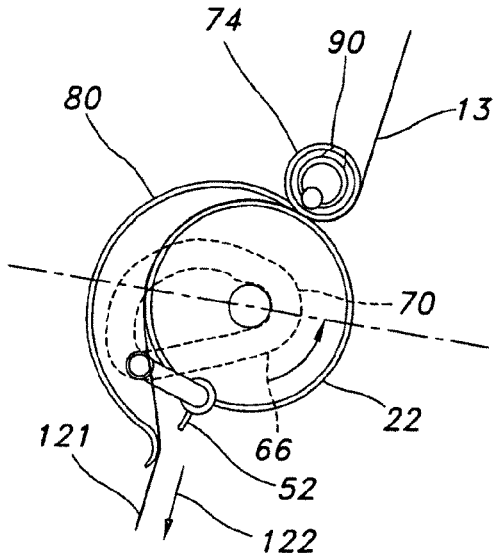
Figure 13:
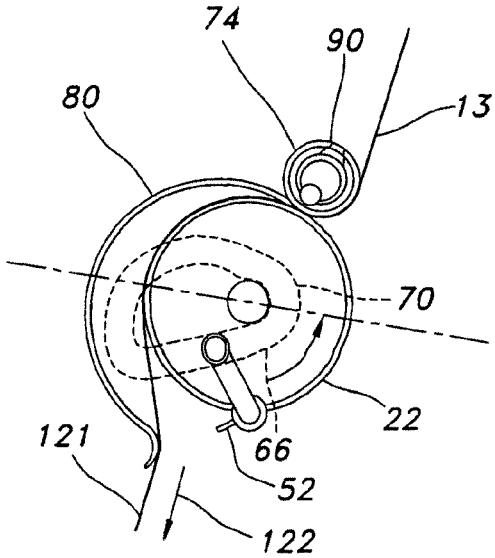

Referring to FIGS. 7 through 13, it can be seen that the cutter blade 52 pivots while the actuator roller 22 rotates during dispensing. The user applies a pulling force 122 by the user grasping the free end 121 of the web material and pulling it in the direction shown in FIGS. 8 through 12. The cutting or toothed edge 53 of the blade 52 engages the underside of the web material on the actuator roller 22 and pushes the web material in an upward direction as shown in FIG. 9. At this point the web material 13 is actually pulled against the teeth 53 of the cutter blade 52. This causes teeth 53 of the cutting blade 52 to begin to sever the web material 13, which will continue to occur during continued rotation of the actuator roller, as is shown in FIGS. 10 and 11. It is noted that the web control members 85, shown in FIG. 4A, may also aid in keeping the web material 13 in contact with the teeth 53 of the cutter blade 52. During the dispensing process, tension on the towel is maintained by the user, guide roller or tensioning device 74 exerting force on the web material 13 and the actuator roller 22 to also contribute to web material tensioning. FIG. 11 shows the severing of the web has begun to take place and FIG. 12 shows the sheet 124 being freed from the newly forming tail 121'. At this point, the sheet 124 is removed from the dispenser. FIG. 13 shows the actuator roller returning to its rest position, shown in FIG. 7. As shown in the illustrations of FIGS. 7-13, a full dispensing cycle is one full rotation of the actuator roller 22.

Figure 16A:
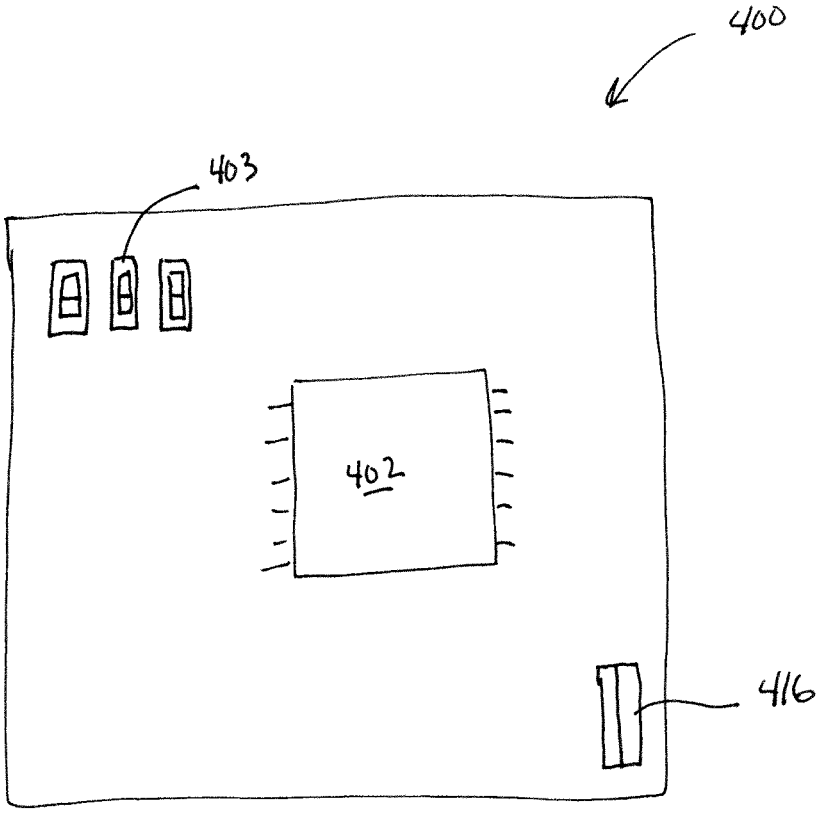
FIG. 16A shows an exemplary control circuit useable in the present invention.

The dispenser 10 of the present invention is provided with a control panel 400 which contains a control circuit 401, as is shown in FIG. 16A. The control panel 400 may be a single panel or several panels electrically connected to one another. The control panel 400 may contain several switches or toggles 403 that allow an owner or a maintainer of the dispenser 10 to set the dispenser 10 to dispense the web material 13 to desired dispensing parameters and operation of the dispenser. For example, the switches 403 may be set the dispenser mode such that the dispenser 10 can operate in a fully manual mode, where the user applies the energy to dispense a sheet of the web material; in a power assist (hybrid) mode, where the dispenser 10 starts to dispense when a user pulls the tail of the sheet material extending from the dispenser; or in an automatic mode, where the dispenser 10 senses a user present in the proximity of the dispenser and the dispenser dispenses a sheet without any energy input from the user. An alternative automatic mode has a sheet of the web material exposed outside the dispenser at the dispensing opening 99 ready to be removed by a user. Upon removing the exposed sheet by the user, the dispenser will automatically dispense advance the web material 13 for the next user or the current user to receive the next sheet. Each of these dispensing modes will be described in more detail below.

The toggle switches 403 could be placed on a separate circuit board or could be located in the internal compartment 11 of the dispenser 10. For example, the toggle switches could be located on the dispensing module frame 15, so that they could be easily adjusted by the owner or maintainer of the dispenser 10.

Figure 16B:
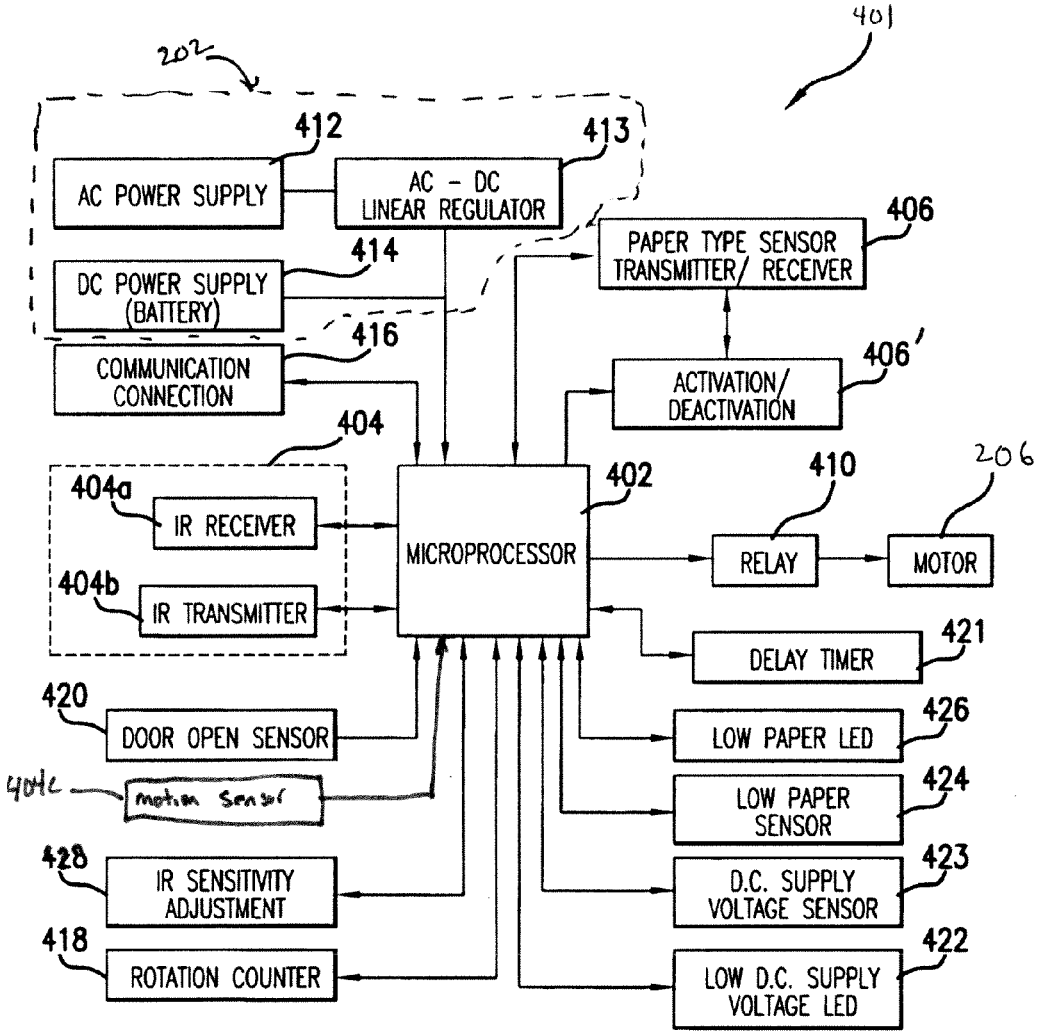
FIG. 16B shows an exemplary control circuit diagram useable in the dispenser of the present invention.

Referring now to FIG. 16B, an exemplary control circuit 401 embodiment of a dispenser 10 control circuit 401 is presented. The control circuit 401 may be powered by a separate power supply (not shown) or may be powered by the power supply 202 which is used to power the motor 206 of the dispenser. Control circuit 401 may included a microprocessor or microcontroller 402 ("microprocessor" and "microcontroller" used interchangeably herein) or a programmable logic microchips or microchip sets. As is stated above, the controller 402 may be a microcontroller or microprocessor controls the functioning of the dispenser by executing code stored in a programmed memory. The microprocessor 402 may have on-board memory and data memory which can be downloaded to check the function of the dispenser and the dispensing parameters in which the dispenser 10 has been dispensing sheets of the web material. In addition, the microprocessor 402 may also learn dispensing patterns and may be programmed to adjust the dispensing parameters in response to dispensing patterns. This is discussed in more detail below. An example of a suitable microcontroller or microprocessor is PIC16F72 available from Microchip Technology. The control circuit 401 may also have a communication connection 416 electrically connected thereto which will facilitate programming/reprogramming of the controller by the owner or maintainer of the dispenser. Alternatively, the communication connection 416 could be used to have the dispenser communicate with a remote computer or monitoring station. Suitable communication connection 416 may include common computer type connections such as, for example, USB connections, convention wired or wireless network connections, a cellular transmitter/receiver and the like.

In addition, the control circuit will also have an activation sensor 404, paper type sensor 406, a motor relay 410 and various sensors, timers, adjustors, and LED indicators (described in more detail later). Control circuit 401 is powered by either A.C. power source 412 or D.C. power source 414. The power source may be the same or different power source which is used to power the motor. Typically, the power source will be the same power source. If A.C. power is used, generally the 120 Volt A.C. line input voltage is reduced to, generally, 6-12 volts using a transformer (not shown). The reduced voltage is rectified and fed into linear regulator 413 which maintains the desired D.C. voltage level required by controller 10. One possible alternative embodiment the D.C. power supply is a battery as is described above. The communication connection 416 is provided to facilitate programming/reprogramming of microcontroller 402 and/or communication between dispenser 10 and a remote computer.

In one aspect of the invention, the control circuit is further connected to an activation sensor 404. Depending on the desired operation of the dispenser 10, the activation sensor 404 may be a sensor that detects the presence of a user desiring a sheet of the web material from the dispenser 10. Suitable activation sensors include, for example, a capacitive proximity sensor, an ultrasonic proximity sensor, an infrared radiation (IR) sensor. Each type of sensor can detect a user's hand reaching for a sheet of the web material. Alternatively, the activation sensor 404 may be a motion detector which senses movement on one or more of the roll material, or the actuator roller 26. The activation sensor 404 can be a detector, such as a conventional passive sensor for detecting infrared (IR) radiation comprising a transmitter 404*a* and receiver 404*b*. Such passive infrared detectors are known in the art. IR transmitter 404*b* transmits a periodic (at random intervals or fixed intervals as desired) pulsed IR signal. IR receiver 404*a* is configured to detect reflected IR signals in the same pattern as the transmitted signal. When such a signal is detected, activation sensor 404 generates an output signal informing microcontroller 402 that a sheet of the web material should be dispensed. Alternatively, the activation sensor may be movement sensor 404*c* which detects movement of one or more actuator roller or roll of the web material. When this movement sensor 404*c* detects movement of the actuator roller or the web material to be dispensed, the movement activation sensor 404*c* generates an output signal informing microcontroller 402 that web material should be dispensed and to activate the motor 206. In another alternative embodiment of the present invention, the activation sensor 404 is activated went the actuator roller 22 nears a particular position in the dispensing cycle. In the or power assist (hybrid) mode, activation sensor 404*c* or sensor is used to determine the position of the actuator roller in the dispensing cycle which will send a signal to the processor to activate the motor and a second switch or sensor sends a second signal to the processor to deactivate the motor, generally as the cutting blade cuts the web material.

In a further embodiment of the present invention, IR sensitivity adjustments or sensor activation control programs may be performed automatically over communication connection 416 using a remote computer or a computer connected to the communication point. It should be noted, however, that dispenser 10 may allow for manual IR sensitivity adjustments using IR sensitivity adjustments 428. These adjustments may be performed using the toggle or multi-way switches discussed above.

When microcontroller 402 determines that activation sensor 404 has been triggered and that dispenser 10 is ready to dispense a sheet of the web material, microcontroller 402 causes sheet of the web material to be dispensed from dispenser 10 by engaging relay 410, thereby applying power to electric motor 206. As the electric motor 206 turns, the roll 11 of the web material 13 turns and web material is forced out of the front of dispenser 10, generally through the dispensing opening 99. As the web material is being dispensed, the microcontroller 402 may optionally monitor an optional rotation counter 418 which outputs a signal for each motor rotation (or roll 11 rotation, or fraction thereof). When rotation counter 418 generates a predefined number of rotation signals, microcontroller 402 may send a signal to the low paper LED or similar light or signal. Alternatively, the rotational counter 418 could also be used by the microprocessor to disengage the electric motor 206 by disengaging the relay 410, thereby removing power to the motor 206 when the proper amount of the web material has be dispensed through the dispensing opening 99.

Generally, in the operation of the dispenser 10, before engaging relay 410, the microcontroller 402 checks the status of a delay circuit 421. The purpose of delay circuit 421 is to prevent consecutive sheet dispensing events until a predefined amount of time elapses. Upon disengaging relay 410 after a web dispensing event, delay circuit 421 is activated.

While delay circuit 421 is active, microcontroller 402 disables relay 410. Delay circuit 421 is designed to "time out" after a predefined amount of time. Such functionality can be achieved using a countdown timer, a count up timer or any other suitable timing technology. For example, delay circuit 421 could be set to "time out" ten seconds after activation. For such a configuration, consecutive sheet dispensing events could not occur faster than once every ten seconds. The processor could be set to dispense multiple sheets consecutively, before the delay circuit 421 is activated. This is called a smart delay, which will allow a user to obtain two or more sheets of the web material before the delay will take effect. This will prevent user frustrations if the user desires more than one sheet of the web material. Generally, the smart delay will allow a user to obtain two sheets of the web material.

Before engaging relay 410, microcontroller 402 checks the status of door open sensor 420, if present. When a user opens front housing 114 or cover to replace the roll 14 or otherwise service dispenser 10, the open door sensor 420 asserts a door open signal that is sensed by microcontroller 402. Upon sensing a door open signal, microcontroller 402 disables relay 410, thereby disabling electric motor 206. This can prevent the maintainer of the dispenser from becoming injured by the cutting blade 52 or otherwise being caught off-guard by a motor 206 activation.

Microcontroller 402 monitors the output of sensor 423. D.C. voltage sensor 423 monitors the output voltage level of D.C. power supply 414. If such voltage level drops below a predefined amount, microcontroller 402 asserts a voltage signal to low D.C. supply voltage LED 422. When such a low signal is asserted, LED 422 will emit light informing a user that the D.C. power source (perhaps a battery) is not providing the proper power to controller 400.

Microcontroller 402 also monitors a low paper sensor 424. One method of sensing a low paper condition may be accomplished using a mechanical arm that rides on roll or positioned on the side of the roll 11 such that sensor will activate with the diameter of the roll is less than a certain value. Generally, the low paper sensor measure the diameter of the roll 11, the low paper sender 424 can be positioned on one of the supports 14 or 16, near the roll engagement member 18. As web material is dispensed from the roll 11 and is dispensed from dispenser 10, roll 11 shrinks in size. Eventually such mechanical arm will activate low paper sensor 424 and a low paper signal will be asserted. When microcontroller 402 detects a low paper signal, microcontroller 402 asserts a signal to low paper LED 426 or similar signal and LED 426 will emit light informing a maintainer or user that the web material source is almost depleted.

Attention is now directed to the product identification sensor 406. When a user opens front housing 114 to replace roll 11 of the web material 13 or otherwise service the dispenser 10, open door sensor 420 asserts a door open signal that is sensed by microcontroller 402. Microcontroller 402, in turn, activates the circuit associated with product identification sensor 406. The product identification sensor determines whether the roll inserted into the dispenser 10 is a recognized product. Suitable product identification sensor 406 may include a simple electrical circuit being completed by the roll 11 of the web material 13 when the roll is inserted into the dispenser, a RFID sensor, an infrared sensor, an ultraviolet light sensor, a capacitance sensor or any other types of sensor which can be used to detect the type of paper that is inserted into the dispenser 10. Each type of product recognition sensor will be described in more detail below.

The simplest paper type detector is completing an electrical circuit. For example, a simple circuit which is completed when the roll 11 is placed in the dispenser 10 on the roll holder 18. On particular example is the core of the roll or web material may have electrical connections therein or thereon that will complete a circuit with contacts on one or both the roll holders. This electrical circuit can run along the length of the core or could simple be located at one of the ends. In this regard, attention is directed to FIG. 17A, FIGS. 17B, and 17C which show an exemplary configuration with may be used in the present invention.

Figure 17A:
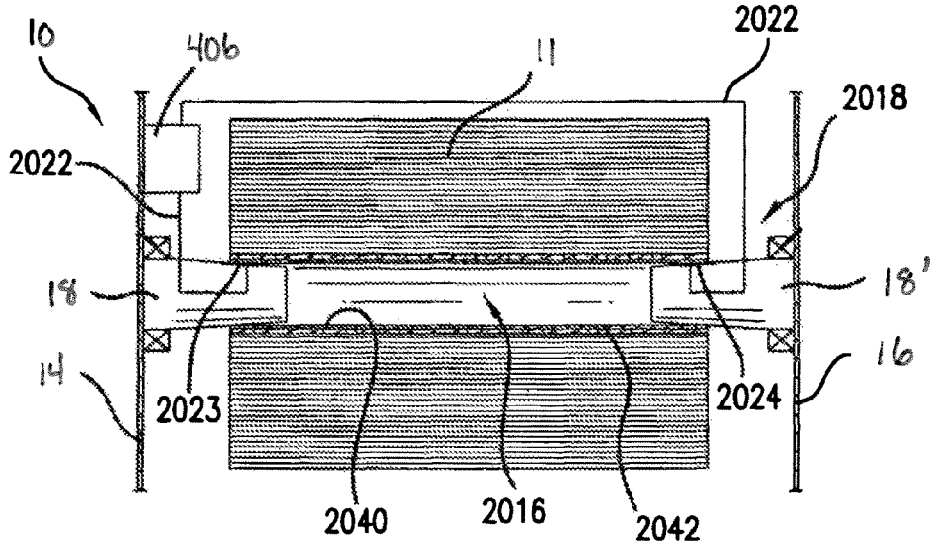
FIGS. 17A, 17B and 17C each show an embodiment useable in the present invention to identify the product using an electrical circuit.

Referring to FIG. 17A, the electrical circuit 2022 has a contact 2023 located on the roll engagement members 18, and the electrical circuit 2022 has another contact 2024 located on the opposite arm 18'. When roll product 11 is not present in the dispenser 10, the electrical circuit 2022 is not complete because a gap will exist between the contacts 2023 and 2024. In this instance, the sensor 406 may indicate that the electrical circuit 2022 is not complete and hence the system will be able to recognize that a particular type of roll product 11 is not present in the dispenser 10.

A particular type of desired roll product 11 may have a core 2016 with a metal coating 2040 located on the inside of the core 2016. Any type of conductive metal or substance may be applied to the inside of the core 2016. For example, the metal coating 2040 may be a layer of copper or aluminum foil that is applied to some or all of the inside of the core 2016. Additionally, other types of electrically conductive materials such as an electrically conductive metal-oxide, iron filings, or electrically conductive silicon may be used. Insertion of the roll product 11 into the dispenser 11 causes the contacts 2023 and 2024 to touch the metal coating 2040 so that the electrical circuit 2022 may be completed from one arm 14 to the other 16. In this manner, the sensor 406 will know that the electrical circuit 2022 is complete and consequently that a particular known type of roll product 11 is present in the dispenser 10. Details of the electrical circuit 2022, such as a power supply thereto, may be provided in any manner commonly known to one having ordinary skill in the art.

Various exemplary embodiments are included for the completion of the electrical circuit 2022. For example, an electrically conductive adhesive 2042 may be applied to the core 2016 for holding the core 2016 together and/or holding sheets onto the core 2016. The electrically conductive adhesive 2042 may be, for example, glue that has iron filings mixed therein, or the electrically conductive adhesive 2042 may be electrically conductive silicon. As such, the core 2016 may be made from materials that are electrically conductive in order to complete the electrical circuit 2022 so as to identify the roll product 11. When formed as a coreless roll, the roll product 11 may be treated with an electrically conductive material during converting when a taffy stick part of the roll is formed so as to be electrically conductive and hence capable of being identified by the dispenser 10.

Figure 17B:
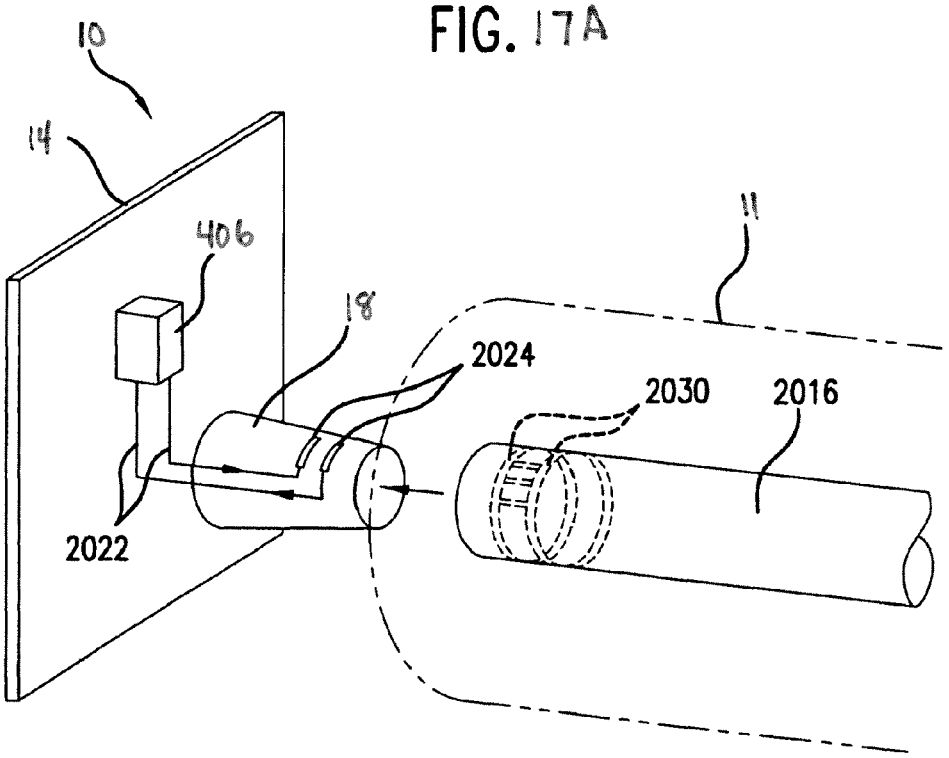

FIG. 17B shows a different exemplary embodiment in which the metal coating 2040 of FIG. 35 is not present. Here, the roll support 18 of the dispenser 10 has a pair of first contacts 2024 located thereon. In this exemplary embodiment, the electrical circuit 2022 need not be opened between the arms 14 and 16 but may be contained upon a roll support 18. As a space exists between the first contacts 2024 the electrical circuit 2022 will be in an open state so that the sensor 406 will indicate that a particular type of roll product 11 is not present on the roll support 18'.

A particular type of roll product 11 with a core 2016 is shown in FIG. 17B as having a conductive element 2030 located thereon. The conductive element 2030 is made of a pair of electrically conductive rings that are located on the inside of the core 2016. The rings are in electrical communication with one another through one or more wires, films or other elements. Placement of the known roll product 11 onto the arm 18 causes the first contacts 2024 to align with the conductive elements 2030 so that the electrical circuit 2022 is completed and hence causes the sensor 406 to indicate that a known product 2014 is present. This identification information may be incorporated into the various, previously discussed systems. For example, the dispenser 10 may dispense according to a prescribed code for a particular known product 2014. If an unknown product 2014 is placed into the dispenser 10, the dispenser 10 may be configured with a separate mechanism for knowing that unknown product 2014 is present and may be run under a default program for dispensing such product.

Figure 17C:
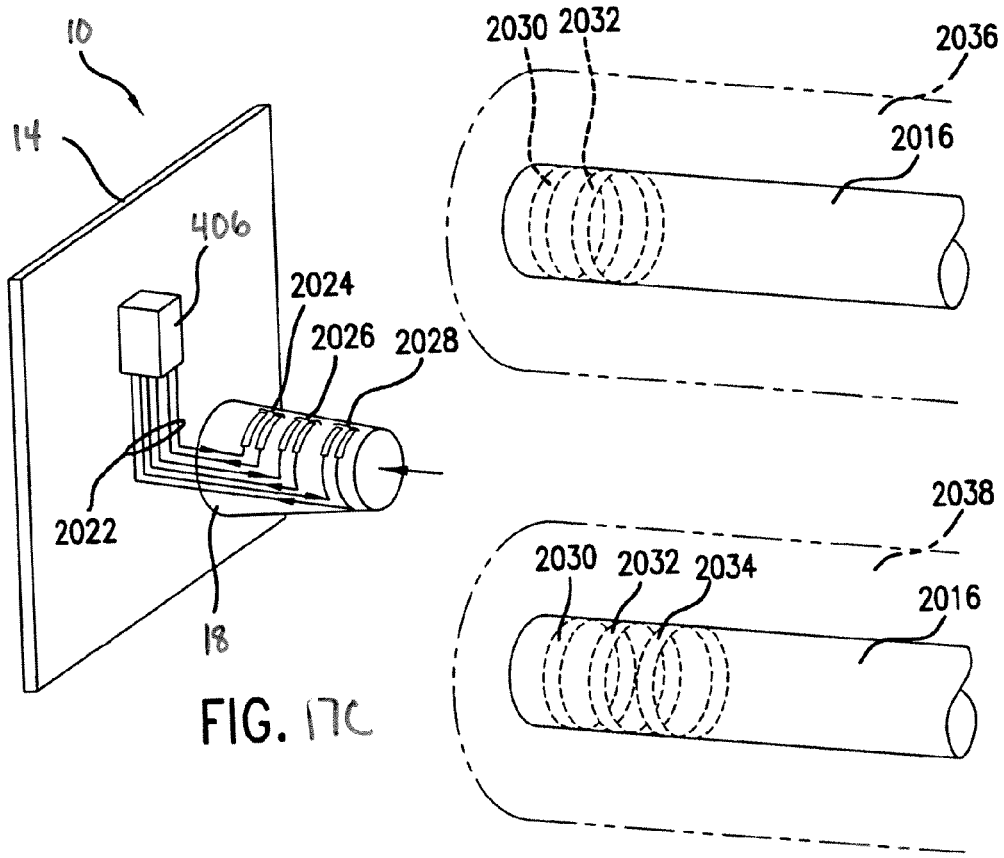

FIG. 17C shows one exemplary embodiment of the dispenser 10 in which the electrical circuit 2022 is configured so as to identify two or more particular types of product 2014. In this exemplary embodiment, a pair of first contacts 2024, a pair of second contacts 2026, and a pair of third contacts 2028 are located on the support roll support 18. The sensor 406 may be in communication with the contacts 2024, 2026 and 2028 so that the sensor 406 is capable of indicting whether the electrical circuit 2022 is completed with respect to each set of contacts 2024, 2026 and 2028. Also shown in FIG. 17C are a first type of product 2036 and a second type of product 2038. The first type of product 2036, may be, for example, a roll of single-ply paper towels while the second type of product 2038 is a double-ply roll of paper towels.

The first type of product 2036 has a pair of conductive elements 2030 and 2032 located on the inside of the core 2016. The second type of product 2038 has an additional conductive element 2034 also located on the inside of the core 2016. The conductive elements 2030, 2032 and 2034 may be, for example, rings made from an electrically conductive material that is either applied to the outside of the inner surface of the core 2016 or located in a recess of the inner surface of the core 2016. Placement of the first type of product 2036 into the dispenser 10 causes the core 2016 to be received by the roll support 18 so that the conductive element 2030 aligns with the first contacts 2024 and so that the conductive element 2032 aligns with the second contacts 2026. The conductive element 2030 is made wide enough to extend between the first contacts 2024 and hence cause completion of the electrical circuit 2022 representative of the first contacts 2024. The conductive element 2032 is configured in a likewise manner so as to complete the electrical circuit 2022 associated with the second contacts 2026 upon placement of the core 2016 onto the roll support 18. In this instance, the electrical circuit 2022 will be closed with respect to the first and second contacts 2024 and 2026, and the electrical circuit 2022 will be open with respect to the third contacts 2028, so that the sensor 406 will know that the first type of product 2036 is located in the dispenser 10. The term "closed" simply means that a part of the electrical circuit 2022 becomes closed.

Placement of the second type of product 2038 into the dispenser 10 will cause the conductive elements 2030, 2032 and 2034 to align with the first, second and third contacts 2024, 2026 and 2028 on the roll support 18. In this instance, the electrical circuit 2022 will become closed with respect to the first, second and third contacts 2024, 2026 and 2028 so that the sensor 406 will know that the second type of product 2038 is present in the dispenser 10. In this manner, the dispenser 10 may be arranged in a variety of manners so that identification information from various types of product 2014 may be obtained and used in the previously disclosed exemplary embodiments for desired dispensing cycles, monitoring, purchasing, or the like.

The electrical circuit 2022 may be arranged so that a variety of combinations are possible to identify various types of products 2014. For example, if only a single pair of the contacts 2024, 2026, or 2028 are closed, the system will be capable of distinguishing between three different types of products 2014. Further, the closing of different combinations of the contacts 2024, 2026 and 2028 may be used to indicate additional types of product 2014 that may be identified in the dispenser 10. Still further, additional contacts may be employed, for example on the other roll support 18', and incorporated into the electrical circuit 2022 so that any number of various products 2014 can be identified in the system.

Figure 18:
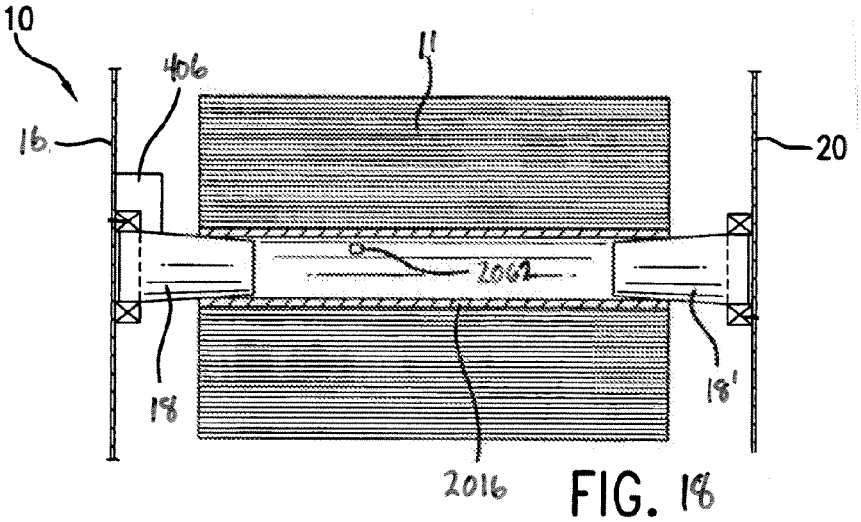
FIG. 18 shows an embodiment useable in the present invention to identify the product using RFID.

One possible embodiment of a product identification sensor transmitter/receiver is an RFID based sensor. Ideally, paper roll 14 is associated with an RFID smart tag. For such a configuration, paper type sensor transmitter/receiver 406 transmits an RFID smart tag trigger signal and listens for transmissions from RFID smart tags associated with paper roll 14. At least part of the received smart tag data is stored in a memory associated with microcontroller 402. Such smart tag data ideally comprises paper type identification information. Such information may be used by microcontroller 402 to automatically configured dispenser 10 operation based on the type of paper inserted into dispenser 10. In this regard, attention is directed to FIG. 18, where the dispenser 10 includes a reader or scanner 406 positioned in a non-limiting example on the on the support arm 16, and by way of another non-limiting example, the core 2016 of the roll 11 carries identification in the form of a Radio Frequency Identification Device (RFID), which in this embodiment comprises a passive "smart" chip or tag 2062. It will be understood that the reader or scanner 406 may be positioned on any portion of the dispenser, or near the dispenser, which permits it to operate in the manner shown and described herein. Similarly, it will be appreciated that the smart tag 2062 may be positioned on any location, or a number of locations, on the sheet material, for example embedded in a coreless roll.

The smart tag 2062 contains information relating to the type of sheet material on the roll 11, for example information relating to the absorbency, the basis weight, manufacturer, etc. of the web material 13 In use, the scanner 406 interrogates the smart tag 2062 with an electronic signal, and the smart tag 2062, which includes an internal antenna (not visible), in turn generates and transmits an electromagnetic pulse that is readable by the scanner to identify the type of web material 131 on the roll 11. The scanner 406 typically is configured to retrieve information from the smart tag 2062 and to decode the information.

RFID smart tag technology is known and understood by those skilled in the art, and a detailed explanation thereof is not necessary for purposes of describing the dispenser and method of the present invention. Generally, conductive or passive smart tags consist of silicon or other semiconductors, a coiled, etched, or stamped antenna, a capacitor, and a substrate on which the components are mounted or embedded. A protective covering typically is used to encapsulate and seal the substrate. Inductive or passive smart tags have been introduced by Motorola under the name BISTATIX®. A detailed description of the BISTATIX® device may be found in U.S. Pat. No. 6,259,367 to Klein, the entire contents of which is incorporated herein by reference. Further information on smart tags and related technology is disclosed in U.S. Pat. No. 6,451,154 to Grabau et al; U.S. Pat. No. 6,354,493 to Mon; U.S. Pat. No. 6,362,738 to Vega; and PCT publication WO 02/48955. Various different RFID tags and scanners are available. RFID tags and scanners suitable for use with the dispenser 10 are available from, for example, Philips Semiconductors of Eindhoven, The Netherlands; Sokymat of Lausanne, Switzerland; Checkpoint Systems Inc. of Miami, Fla.; and Omron Company of Tokyo, Japan.

Alternatively, the smart tags 2062 may be an active device. In this configuration, the smart tag 2062 includes active transceiving circuitry that has the capability to selectively respond to coded request signals transmitted by a scanner. An active smart tag 2062 may include the capability to receive and store additional information beyond the information contained in its fixed code. An active smart tag 2062 requires an internal power supply, such as a micro-battery, thin film battery, and so forth (not shown).

Figure 19A:
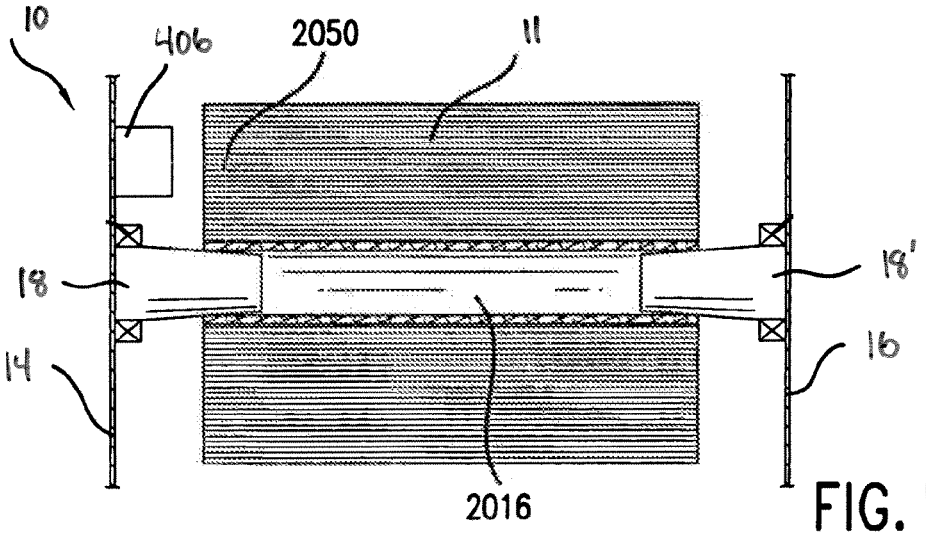
FIGS. 19A and 19B show an embodiment useable in the present invention to identify the product using ultraviolet light.
Figure 19B:
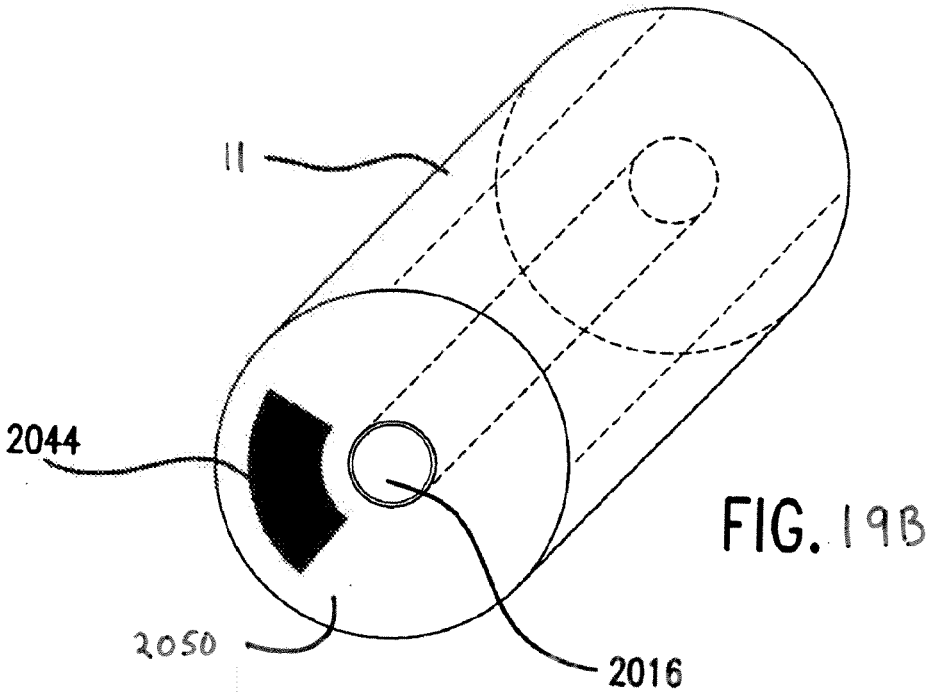

In the case of the ultraviolet light product identification sensor, an ultraviolet light emitter/detector sensor 406 is directed at a portion of the roll 11 loaded into the dispenser 10. The portion of the roll 11, including a roll cap or the side of the paper will have an invisible ink that is fluorescent when exposed to ultraviolet light from the transmitter. This configuration is shown in FIGS. 19A and 19B. The ultraviolet light detector detects 406 the fluorescence which may be in pattern, thereby confirming the product which is inserted into the dispenser 10. In this regard, attention is directed to FIG. 19A, where the dispenser 10 includes a ultraviolet light emitter/detector sensor 406 positioned in a non-limiting example on the on the support arm 16. The roll 11 is placed on the roll supports 18, 18' such that the side 2050 with the fluorescent ink 2044 as shown in FIG. 19B is adjacent the ultraviolet light emitter/detect sensor 406. The fluorescent area 2044 may be identified by the sensor 406 in FIG. 19A so as to identify the web material 13 of the roll 11. The intensity of the fluorescent area 2044 may be varied between different products 2014 so that the sensor 406 is capable of distinguishing between the various types of web materials 13.

The fluorescent area 2044 may be present from the material making up the core 2016 or the web material in the roll product 11 that could be naturally fluorescent. Further, the fluorescent area 2044 may be applied to the rolled product 11 by fluorescent pigments, paints or inks so as to render the rolled product 11 UV-responsive. In this instance, the substance may be sprayed onto the side of the rolled product during manufacturing. The fluorescent area 2044 may be clear and invisible under normal light yet detectable by the sensor 406. Any type of sensor 406 capable of detecting the fluorescent area 2044 may be employed. For example, a fluorescent sensor manufactured by EMX Industries, Inc. having offices at 4564 Johnston Parkway, Cleveland, Ohio may be used in accordance with one exemplary embodiment.

The use of a fluorescent area 2044 may be desirable in that the substance, if used, to provide the UV marker may be incorporated into adhesives or other necessary parts of the rolled product 11. Also, the fluorescent area 2044 may be a substance that does not react with or otherwise impede the functionality of the rolled product 11. Additionally, as the fluorescent area 2044 may be invisible under normal lighting conditions, the rolled product 11 may be marked in an inconspicuous manner to the end consumer. Although described as being applied to the side of the rolled product 11, the fluorescent area 2044 may be located at other portions on the rolled product 11 in accordance with other exemplary embodiments.

Figure 20:
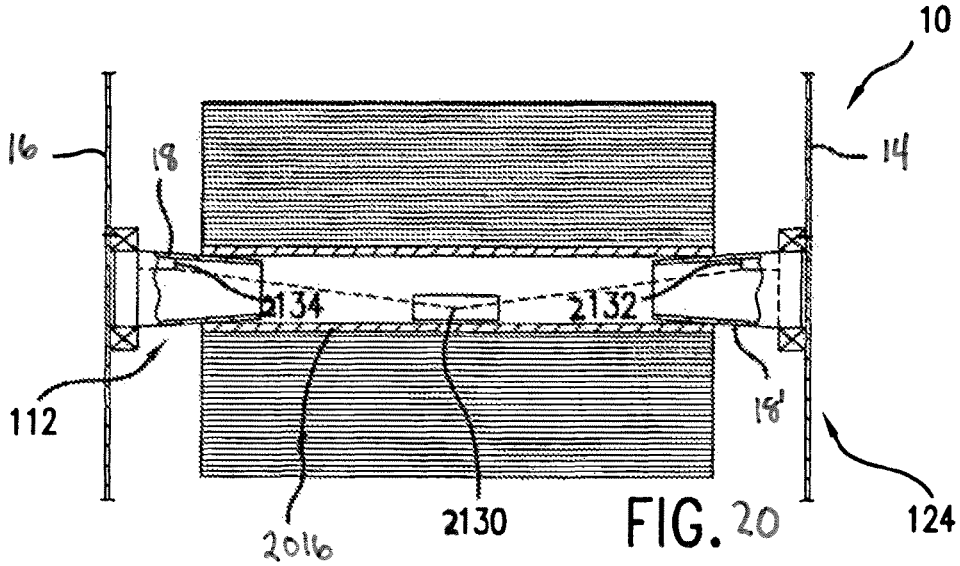
FIG. 20 shows an embodiment useable in the present invention to identify the product using RFID.

Infrared or visible light product identification sensor may also be used. The infrared or visible light emitter will direct the light in a direction, for example, through the core of the rolled product. FIG. 20 illustrates a portion of a dispenser 10 in which the web material roll 11 is placed on a pair of roll supports 18, 18', which are located on support arms 14 and 16. As can be seen, the roll 11 carries a filter 2130 in the core 2016 the roll support 18 includes an infrared emitter 2132 and an infrared detector 2134 in the roll support 18' The emitter 2132 is arranged to emit angled infrared light into the core 2016 of the roll 11, as shown, which upon reflection off or through the filter 2130 is detected by the infrared detector 2134 to complete an infrared emitter/detector circuit. The detector or receiver 2134 could be set-up to identify a pattern or particular wavelengths of IR or visible light or the mere presence of such light. If an unrecognized product is inserted into the dispenser 10, the infrared emitter/detector circuit will not be completed, and typically the dispenser will default to a setting for a less absorbent sheet material in which a relatively long length of sheet material is dispensed. Recognition of different rolls of sheet materials in this embodiment may be accomplished by adjusting the relative reflectivity of the label and therefore total reflected light for various sheet materials. Apart from the infrared emitter/detector circuit, the dispenser 10 is similar in all other respects to the dispenser 10 described above. Alternatively, IR or visible light emitter and receiver may be located on one side of the roll core as a pair. Infrared or visible light from the emitter is reflected back through a filter to the receiver and thereby identifies the product as depending on the wavelength received which corresponds to that which is stored in the microprocessor.

Other types of product type identification sensors may be use, including, for example, ultrasonic and capacitance sensors.

Generally, the control circuit 401 may be powered by a separate power supply (not shown) or may be powered by the power source 202 is used to power the motor 206 of the dispenser. In any event, the control circuit 401 is in electrical communication with the power source 202 and the motor 206 and controls the power supplied to the motor 206.

Depending on the desired functionality of the dispenser 10, the dispenser 10 can also have other features and functions. One particular dispenser 10 may have a series of multi-positioned switches 403, that may be located on the control circuit 400 or located in the internal compartment 111 such that a maintainer of the dispenser 10 will be able to easily select the mode in which the dispenser 10 will operate. For example, the switches 403 may be located on the dispensing module 12. The dispenser 10 of the present invention can be set to dispense product in different modes, including fully electronically, partially electronically or manually. A three-way switch 403 could be used to allow the maintainer to select the mode in which the dispenser dispenses the web material. In the full electronic mode, the dispenser will have an activation sensor 404, which is described above. The activation sensor 404 which will detect the users hand proximate to the dispenser 10 or may detect that the user has removed the sheet of the web material 13' form the dispenser 10. In the full electronic mode, the dispenser 10 could be set up such that the sheet of the web material 13' is not dispensed until a user's hand is detected under the dispensing opening 99 the dispenser 10. This mode is often referred to as the hygienic mode. In this mode, the activation sensor 404 will sense the user's hand around the dispensing opening 99 and will send a signal to the control circuit 401. The control circuit 401 will activate the motor 206 through the relay 410 and the dispenser will dispense a sheet of the web material to the user. As is stated above, the dispenser 10 of the present invention pre-cuts the sheet of towel for the user so the user needs little force to remove the sheet form the dispenser 10. Once removed, the dispenser 10 will not dispense another sheet of the web material 13' until a user's hand is placed proximate dispensing opening 99 and/or activation sensor 404.

Alternatively, in the full electronic mode, the dispenser 10 could be set to leave a sheet of the web material 13 extending from the dispensing opening 99 of the dispenser 10, as is shown in FIG. 2A. A user will walk up to the dispenser 10 and remove the exposed sheet 13' from the dispenser. In this mode the activation sensor 404 will sense that the sheet 13' has been removed and will send a signal to the control circuit 401 to dispense another sheet 13' of the web material for the next user. The next sheet 13' of the web material will be dispensed from the dispenser 10 so that the sheet will be available for the next user. This mode is sometimes referred to as the "stadium mode". Typically, this mode is intended for high traffic areas that need to dispense the sheets repeated in a short period of time. Examples of these high traffic areas are malls, stadiums, amusement parks and the like.

Another mode the dispenser 10 of the present invention can operate is called an assist mode. In the assist mode, a portion of the web material 13 is exposed below in the dispensing opening 99 of the dispenser 10. The exposed portion is often referred to as a tail. A user pulls on the tail to remove the sheet similar to a manual dispenser. However, an activation switch 404*c* detects movement of the web material 13 or the actuator roller 22 in the dispenser 10 and communicates this information to the control circuit 401. The control circuit 401 activates the motor 206 through the motor relay 410 and assists the user in removing a sheet 13' of the web material from the dispenser 10. The motor will shut off at a predetermined point where the momentum generated by the user and the motor 206 will be sufficient to leave another tail of the web material 13 for the next user to repeat the process. This predetermined point may be detected by a sensor or a switch. An example of an assist mode dispenser is disclosed in U.S. Patent Application Publication 2009/0140001 by Lewis et al. Generally, in the assist mode, a one way drive system is coupled with the motor to engage the motor such that if a user continues to pull on the towel when the motor engages, the motor will be caused to disengage from the actuator roller, thereby saving battery life and wear on the motor. A one way drive system is shown in, for example U.S. Patent Application Publication 2007/0079684 by Friesen et al. Generally, the one-way drive may utilize a bearing clutch, a floating gear or another mechanism which is effective in disengaging the motor form the actuator roller. In the power assist (hybrid) mode a tail of sheet material is exposed below the dispensing opening. As the user grasps and pulls on exposed sheet, the actuator roller begins to rotate. The rotation of the actuator roller will activate a switch located beneath on a cam or in communication with the actuator roller. The switch activates the drive motor dispensing the sheet. If user continues to pull the sheet as the motor is running, the one-way drive effectively removes the load from the motor and therefore the drain on batteries. An emergency feed knob incorporates three cam surfaces and three switches, which may be located on the circuit board located beneath the emergency knob, which are used to signal motor start and stop, determine position of a sheet, advance a short tail to the proper position, adjust for incorrect dispensing such as sheet over pull.

In another mode of operation, the dispenser 10 may be fully manual, meaning that the user will need to apply force to the towel material to advance and remove a sheet of the web material from the dispenser. In the fully manual mode, a portion of the sheet 13' is exposed below in the dispensing opening 99 of the dispenser. The exposed portion is called a tail. A user pulls on the tail to remove the sheet of the paper towel. The cutter blade severs a sheet of the towel from the roll and leaves a new tail portion for the next user.

Each of these three modes may be selected by the maintainer of the dispenser by providing a three-way switch, one way for each dispensing mode. Alternatively, the control circuit 401 could select the mode in which the dispenser is going to operate, depending on the towel material installed in the dispenser. For example, if the product identification sensor senses a product which is unknown the dispenser could automatically be switched to a manual mode or a power assist (hybrid) mode. Alternatively, if the power source is deemed by the control circuit to be low on power, the dispenser may switch to a power assist (hybrid) mode or a manual mode to preserve power.

The delay circuit 421 can be set to various times. The circuit may be set such that there is no delay, a short delay such as a 1-5 second, or a delay that takes effect after two or more sheets of the towel are dispensed by the dispenser. A reason to set the delay is to prevent the dispenser from dispensing more sheets than necessary for a given task. By placing a delay of a few seconds, a user will more than likely not stand and wait for additional sheets to be dispensed from the dispenser and will use the sheet or sheets provided. This will prevent waste of the sheet material dispensed from the dispenser. In one embodiment of the present invention, the delay will not take effect until two sheet have been dispensed in rapid succession, which is referred to herein as a smart delay. That way a user will be provided with a sufficient amount of paper towels to dry their hands, if the dispenser is used in restrooms. However, if the dispenser is used in a location where rapid towel dispensing is needed, such as food service, to clean-up a spill, the dispenser could be set to dispense without any delay. A multi-way switch may be used to set the time delay. Alternatively, the time delay may be set in the processor through the communication port.

As previously discussed this dispenser may operate in three modes of operation. In the hygienic or hidden mode, the sheet material is held within the dispenser until an end user places their hand beneath the hand sensor (activation sensor to trigger a dispenser cycle. Once the sheet has been dispensed, the hand sensor remains off until the system determines the dispensed sheet has been removed. Since there are multiple sensors incorporated in the unit, sensors other than the hand sensor may be used to determine if the sheet has been removed. The combination of sensors can be used in the various modes to detect the presence or position of the sheet. In the exposed mode a sheet would be dispensed and left hanging until removed by a user. Once the dispenser, via the sensors, determines that the sheet has been removed, a delay, if applicable or desired, is applied followed by the dispensing of a new sheet of material for the same or next user upon detection or redetection of the user's hand.

To summarize, some of the features of the dispenser of the present invention can be adjusted by the maintainer of dispenser. include a) mode setting—hidden, exposed and power assist; b) smart delay—no delay, delay after every sheet and delay after two sheets or more sheets have been dispensed in succession; c) delay time—initially set at 1, 3 and 5 seconds; d) hand sensor sensitivity—short, medium and long. Also included in the system is a lock out switch that removes power from the motor and sensors when the dispenser cover is open. Additionally, although not needed if the unit has an emergency knob, a sheet feed button may be incorporated to assist in loading a new roll of sheet material.

Figure 21:
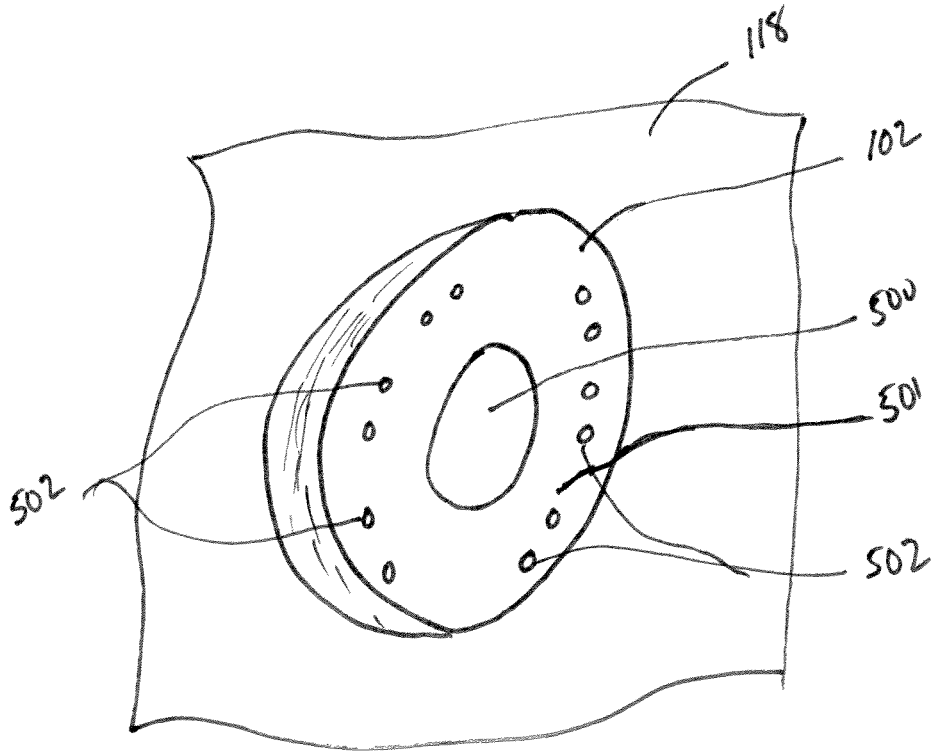
FIG. 21 shows an exemplary emergency feed knob which may be used in the present invention.

In another embodiment of the present invention, the dispenser incorporates a translucent emergency feed knob 102 shown in FIGS. 1 and 21. The emergency feed knob 102 may be formed with an opaque center section 500 thereby leaving a translucent outer ring 501. Located around this translucent outer ring are several small, high efficiency LED lights 502 behind the translucent outer ring. The LED lights 502 may be any color but are preferred to be at least two different colors, which will be referred to as a first color and a second color. For example, the LED lights 502 may be six yellow and six red LEDs. By way of example only, when a low product signal is received by the control circuit 401, the six yellow lights around the outer ring 501 of the knob 102 will begin to blink, presenting a significantly more visible signal to maintenance than the typical single led light. When a low battery signal is received, the six red LEDs 502 will begin blinking. In a situation where both product and batteries reach a low state the three front yellow LEDs and the three rear red LEDs blink. If a jam is detected by the system, either by elapsed time without seeing a sheet or over current, the red LEDs behind the translucent outer ring will blink in sequence in a counter clockwise direction to indicate a jam and the direction to turn the knob. The LEDs 502 provide a way to communicate to a maintainer of the dispenser that maintenance needs to be performed on the dispenser.

The microprocessor 402 and the control circuit 401 can effectively operate the dispenser. If the product sensor 406 is unable to identify the roll product 11 placed in the dispenser, the microprocessor will be able to change the dispensing parameters, including speed the web material 13 is dispensed, the length of the delay 421, the ability to change from one dispensing mode to another, dispense multiple sheets and the like. Generally, if the roll product 11 is not recognized, the dispenser will switch to a fully manual mode, where the user will have to input power to dispense the sheet material. Alternatively, the dispenser could switch the mode to a fully sanitary mode, dispensing multiple sheets at a time. It may be desirable to dispense multiply sheets, in the absorbency of the roll product in the dispenser would not be known.

In a further embodiment, if the product is recognized, the dispenser could set the dispensing mode which is best suited for dispensing the recognized product. For example, one product would be best suited to be dispensed in a fully electronic mode, while others will be better suited for a power assist mode.

Although the present invention has been described with reference to various embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

We claim:

1. A dispenser for dispensing sheets from a roll of a web material comprising:

a housing which forms an interior compartment of the dispenser;

a holder located within the compartment, the holder serves to support at least one roll of a web material to be dispensed from the dispenser;

an actuator roller located within the compartment, the actuator roller having a rotational path;

a cutting blade located within the actuator roller, wherein the cutting blade extends from the actuator roller to cut the web material to form a sheet of the web material to be dispensed from the dispenser during the rotational path of the actuator roller;

a motor engagably connected to the actuator roller;

a control circuit in communication with the motor;

a product identification sensor in communication with the control circuit, said sensor detects and identifies information about the roll from an information identifier associated with the roll of the web material placed in the holder and relays this information to the control circuit;

wherein the control circuit adjusts dispensing parameters for the actuator roller in dispensing a sheet of the web material from the dispenser in response to a signal from said product identification sensor.

2. The dispenser according to claim 1, further comprising a power supply connected to the motor.

3. The dispenser according to claim 1, further comprising a motor activation means, which activates the motor, the motor activation means is in communication with the control circuit.

4. The dispenser according to claim 1, wherein the product identification sensor comprises a RFID reader, an ultraviolet light filter, an infrared filter, a capacitance detector, or a completed electrical circuit sensor.

5. The dispenser according to claim 1, further comprising a delay circuit, the delay circuit delays the dispensing of the next sheet from the dispenser for a period of time.

6. The dispenser according to claim 5, wherein the delay circuit delays the dispensing of the next sheet after two sheets are removed within a set period of time.

7. The dispenser according to claim 5, wherein delay circuit time delay is adjusted with a multi-position switch.

8. The dispenser according to claim 1, further comprising an activation sensor, the activation sensor is in communication with the control circuit, the activation sensor detects the presence of a user's hand near the dispenser and sends a signal to the control circuit to dispense a sheet of the web material.

9. The dispenser according to claim 8, wherein the activation sensor comprises an infrared sensor, a capacitive proximity sensor, or an ultrasonic proximity sensor.

10. The dispenser according to claim 9, wherein the activation sensor is located toward the bottom of the housing, and the activation sensor projects downward from the bottom of the housing.

11. The dispenser according to claim 1, wherein the control circuit adjusts the speed of the motor based on the product recognized.

12. The dispenser according to claim 1, wherein the control circuit engages the motor to dispense multiple sheets of the web material when the product identification sensor does not recognize the product loaded in the dispenser.

13. The dispenser according to claim 1, wherein the control circuit disengages the motor when the product identification sensor does not recognize the product loaded in the dispenser.

14. The dispenser according to claim 1, wherein the control circuit adjusts the dispensing mode based on the information the product identification sensor determines about the roll of the web material placed in the dispenser.

15. The dispenser according to claim 2, wherein the power supply comprises a removable battery compartment which facilitates replacement of batteries used to power the dispenser.

16. The dispenser according to claim 1, wherein the dispenser has a series of LED's to convey the maintenance state of the dispenser.

* * * * *